US012270215B1

(12) United States Patent
Van Buren et al.

(10) Patent No.: US 12,270,215 B1
(45) Date of Patent: Apr. 8, 2025

(54) REENTRY TRANSITIONAL HOUSING SYSTEM AND METHOD

(71) Applicant: Designing Justice + Designing Spaces, Oakland, CA (US)

(72) Inventors: Deanna Van Buren, Oakland, CA (US); Shelley Roberts, San Pablo, CA (US); Oretola Thomas, Oakland, CA (US)

(73) Assignee: Designing Justice + Designing Spaces, Oakland, CA (US)

( * ) Notice: Subject to any disclaimer, the term of this patent is extended or adjusted under 35 U.S.C. 154(b) by 698 days.

(21) Appl. No.: 17/384,526

(22) Filed: Jul. 23, 2021

Related U.S. Application Data

(60) Provisional application No. 63/056,507, filed on Jul. 24, 2020.

(51) Int. Cl.
*E04H 1/12* (2006.01)
*E04H 1/02* (2006.01)

(52) U.S. Cl.
CPC ..... *E04H 1/125* (2013.01); *E04H 1/02* (2013.01)

(58) Field of Classification Search
CPC ..... E04H 1/125; E04H 1/02; E04H 1/1205; E04B 1/348
See application file for complete search history.

(56) References Cited

U.S. PATENT DOCUMENTS 3,042,978 A * 7/1962 Eames ..... A47B 47/00 52/64
3,748,010 A * 7/1973 Garte ..... A47B 77/10 D6/664
4,324,076 A * 4/1982 Honickman ..... A47B 96/205 52/27
4,843,788 A 7/1989 Gavin et al.
(Continued)

OTHER PUBLICATIONS

Bailey, Keith A., MDiv, MS, "The Role of the Physical Environment for Children in Residential Care," Residential Treatment for Children and Youth, (2002), pp. 15-27, vol. 20.
(Continued)

*Primary Examiner* — Paola Agudelo
(74) *Attorney, Agent, or Firm* — Orrick, Herrington & Sutcliffe, LLP

(57) ABSTRACT

A reentry transitional housing system for providing access to housing and social services and methods for making and utilizing the same. The reentry transitional housing system can include at least one refuge room for providing living quarters to a recently-released individual. In selected embodiments, each refuge room can be equipped with one or more furniture components, such as a bed, a desk, and storage space. A folding panel and a sliding door can be flat-packed inside the refuge room and can be assembled to create a unique enclosure. Advantageously, a plurality of the refuge rooms can be deployed in a clustered configuration within a predetermined space with each refuge room being adapted to meet customized personal preferences of the
(Continued)

individual. In addition to providing living quarters, the reentry transitional housing system optionally can provide a workforce development opportunity in both digital and physical fabrication.

20 Claims, 24 Drawing Sheets

(56) References Cited

U.S. PATENT DOCUMENTS 4,953,246 A * 9/1990 Matthews ..... A61G 7/00 5/8
5,394,658 A * 3/1995 Schreiner ..... E04B 2/7422 312/196
5,601,348 A * 2/1997 Minkovski ..... A47C 17/52 312/238
5,678,905 A * 10/1997 Kelley ..... A47B 21/00 312/258
5,784,843 A * 7/1998 Greer ..... A47B 83/001 52/506.01
6,067,762 A * 5/2000 Greer ..... A47B 57/425 52/239
D559,997 S 1/2008 Sugimori et al.
7,913,459 B2 * 3/2011 Ball ..... A47B 83/001 52/239
D700,356 S * 2/2014 Svensson ..... D25/32
9,084,489 B2 * 7/2015 Gosling ..... A47C 17/38
9,222,255 B2 * 12/2015 Johnson ..... E04B 1/343
9,237,803 B2 * 1/2016 Kassanoff ..... A47B 47/05
9,578,963 B2 * 2/2017 Mayer ..... A47B 96/16
D831,225 S 10/2018 Ishizawa
10,577,788 B1 * 3/2020 Zail ..... E04B 1/343
D884,395 S * 5/2020 Flora ..... D6/663
2003/0159366 A1 * 8/2003 Christensen ..... E04H 1/125 52/79.1
2010/0043142 A1 * 2/2010 Whitford ..... A47C 17/46 5/136
2011/0083379 A1 4/2011 Lavi
2016/0348390 A1 * 12/2016 Baggiero, II ..... E04H 9/10
2016/0376784 A1 * 12/2016 Timur ..... E04B 1/343 52/27
2019/0328133 A1 * 10/2019 Kassanoff ..... A47B 47/03
2020/0095787 A1 * 3/2020 Van Aukee ..... E04B 1/34861
2020/0347626 A1 * 11/2020 Petty ..... E04H 1/1255
2022/0136231 A1 * 5/2022 Zail ..... E04B 2/827 52/65
2022/0268042 A1 * 8/2022 Watanabe ..... A47B 83/02

OTHER PUBLICATIONS

Devlin, Ann Sloan, et al., "Health Care Environments and Patient Outcomes: A Review of the Literature," Environment and Behavior, (2003), vol. 35, No. 5, http://eab.sagepub.com/cgi/content/abstract/35/5/665.
Heschong Mahone Group, "Windows and Offices: A Study of Office Worker Performance and the Indoor Environment," California Energy Commission, (Oct. 2003), pp. 1-143.
Pressly, Page K, M. H., "The Physical Environment and Counseling: A review of Theory and Research." Journal of Counseling and Development, (Spring 2001), pp. 148-160, vol. 79.
Ulrich, Roger S., Ph.D., et al., "A Review of the Research Literature on Evidence-Based Healthcare Design (Part I)," Health Environments Research & Design, (Spring 2008), pp. 27-38, vol. 1, No. 3.
Van Buren, D. et al., "Peace in Place Project: Building Healing Spaces," Collaborative Law Review Journal, (2015), pp. 11-17.

* cited by examiner

REENTRY TRANSITIONAL HOUSING SYSTEM AND METHOD

CROSS-REFERENCE TO RELATED APPLICATIONS

This application claims the benefit of, and priority to, U.S. Provisional Application Ser. No. 63/056,507, filed Jul. 24, 2020, the disclosure of which is hereby incorporated herein by reference in its entirety and for all purposes.

FIELD

The disclosed embodiments relate generally to the field of housing and more particularly, but not exclusively, to reentry transitional housing systems and methods for providing access to housing and social services for released individuals.

BACKGROUND

In the United States, nearly ten million individuals are released from federal and state prisons or county jails each year. Providing social services to the released individuals helps to facilitate successful reentry into society and promote public safety. A lack of affordable housing, however, requires these released individuals to compete for the same limited resources with other individuals who have no criminal history. According to recent statistics, more than ten percent of the released individuals become homeless within months of their release, increasing the risk that the released individuals will reoffend and be again incarcerated.

Formerly-incarcerated individuals face numerous challenges, which, in too many instances, prevent reintegration into communities so that the individuals can thrive. To balance the high cost of construction and support, the volume of individuals decarcerating within each reentry housing facility needs to be re-envisioned. While robust supportive programming is in place, living conditions in most current reentry housing facilities are organized with many people, sometimes up to ten or more, housed in a single room and deprive the formerly-incarcerated individuals of basic human rights such as privacy and dignity. Such dense living conditions can cause trauma to the formerly-incarcerated individuals, exacerbating the challenges of reintegration.

In view of the foregoing, a need exists for an improved reentry transitional housing system and method for providing housing integrated with programming that includes access to job training, trauma-informed education, mental health support and full supportive services that overcome the aforementioned obstacles and deficiencies of currently-available reentry programs for released individuals.

Figure 1A:
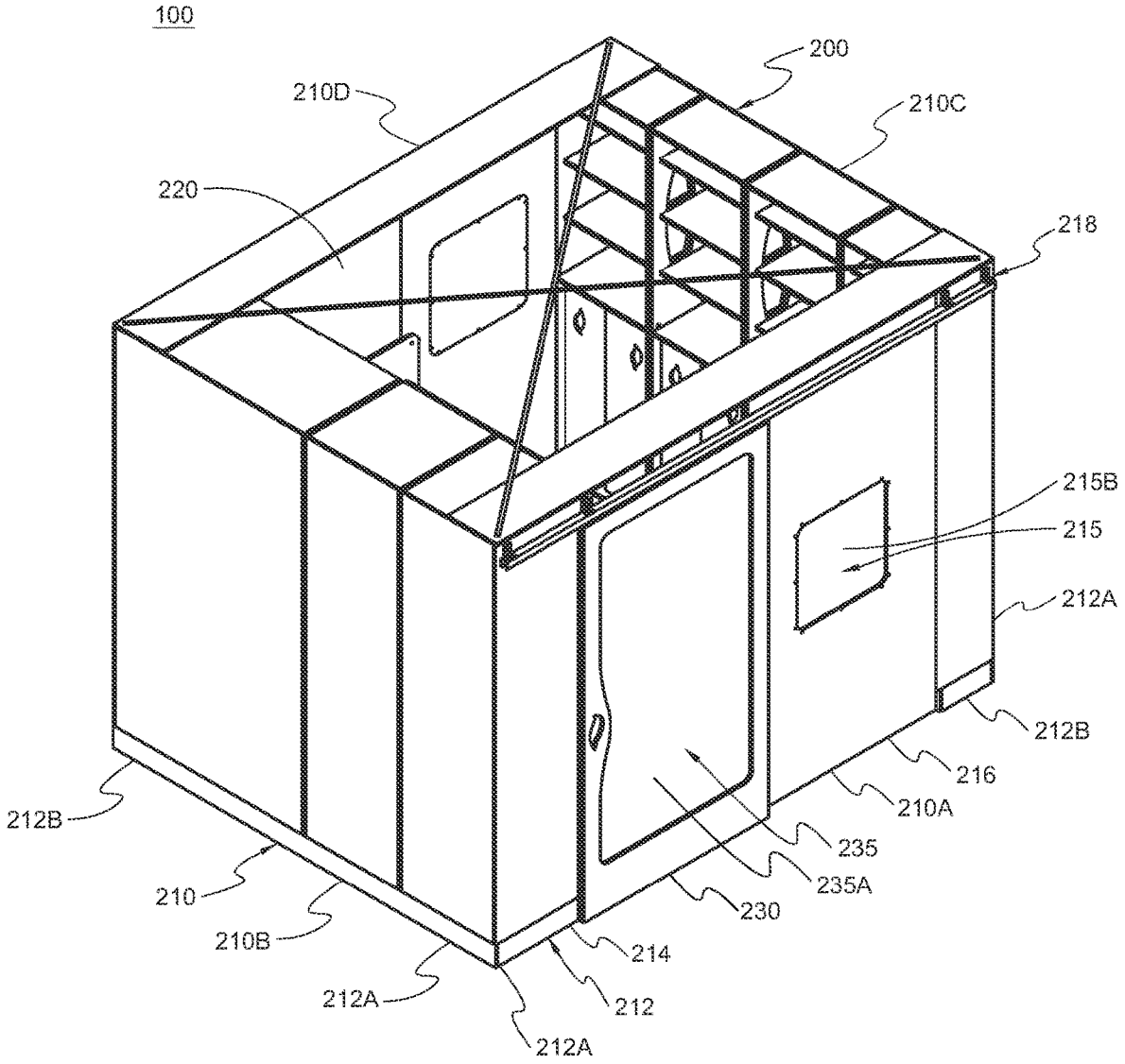
FIGS. 1A-C are detail diagrams illustrating an exemplary embodiment of a reentry transitional housing system, wherein the reentry transitional housing system includes a modular refuge room comprising a plurality of side barrier members.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available reentry transitional housing fails to provide privacy, dignity, trauma-informed design critical to supporting reintegration into daily life as well as otherwise require released individuals to compete for limited resources, a reentry transitional housing system and method for providing housing and supportive services can prove desirable and provide a basis for a wide range of applications, such as providing modular living quarters for a released individual who is reentering a community after release from incarceration. This result can be achieved, according to one embodiment disclosed herein, by a reentry transitional housing system 100 as illustrated in FIGS. 1A-C.

Figure 1B:
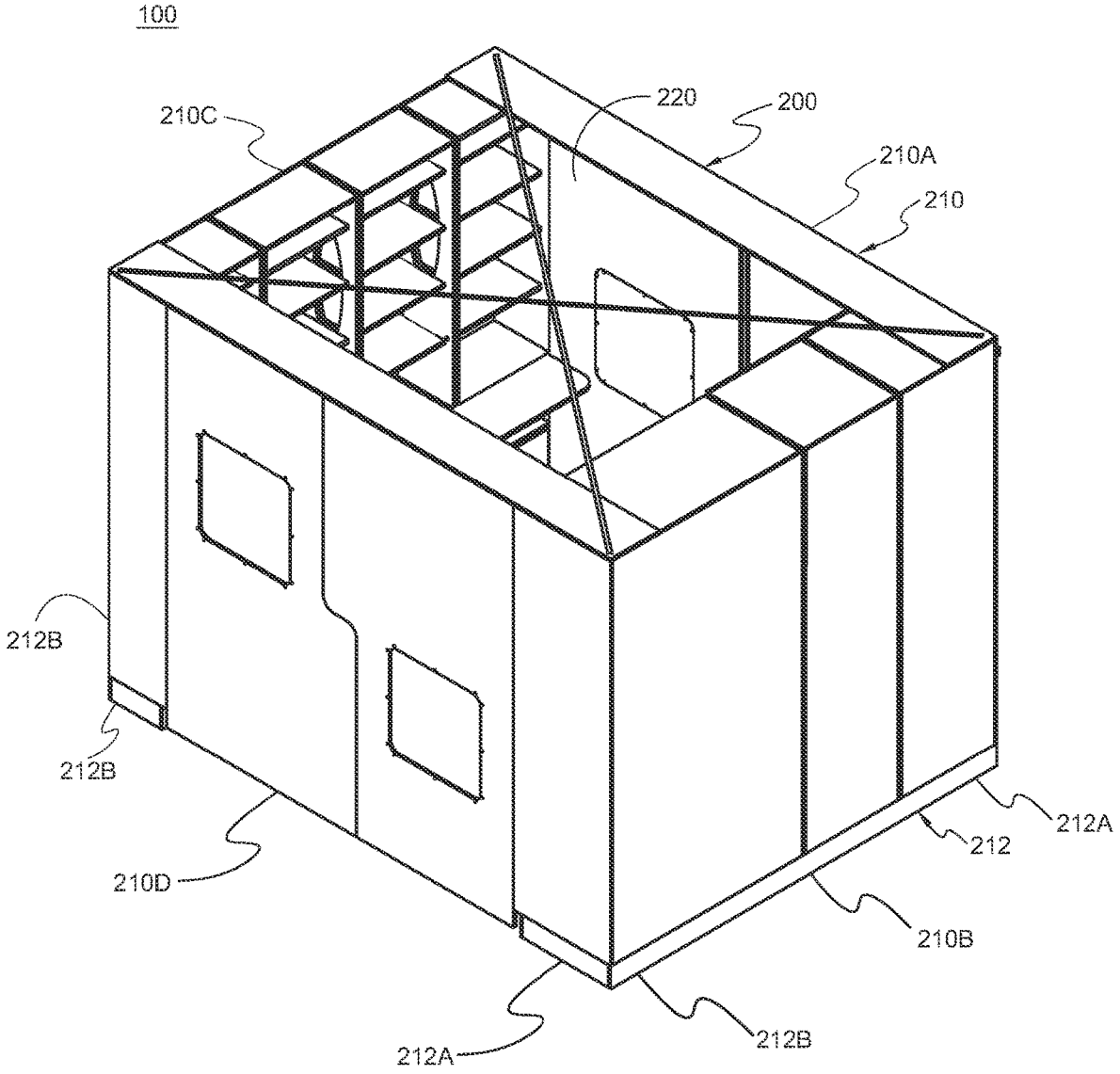
Figure 1C:
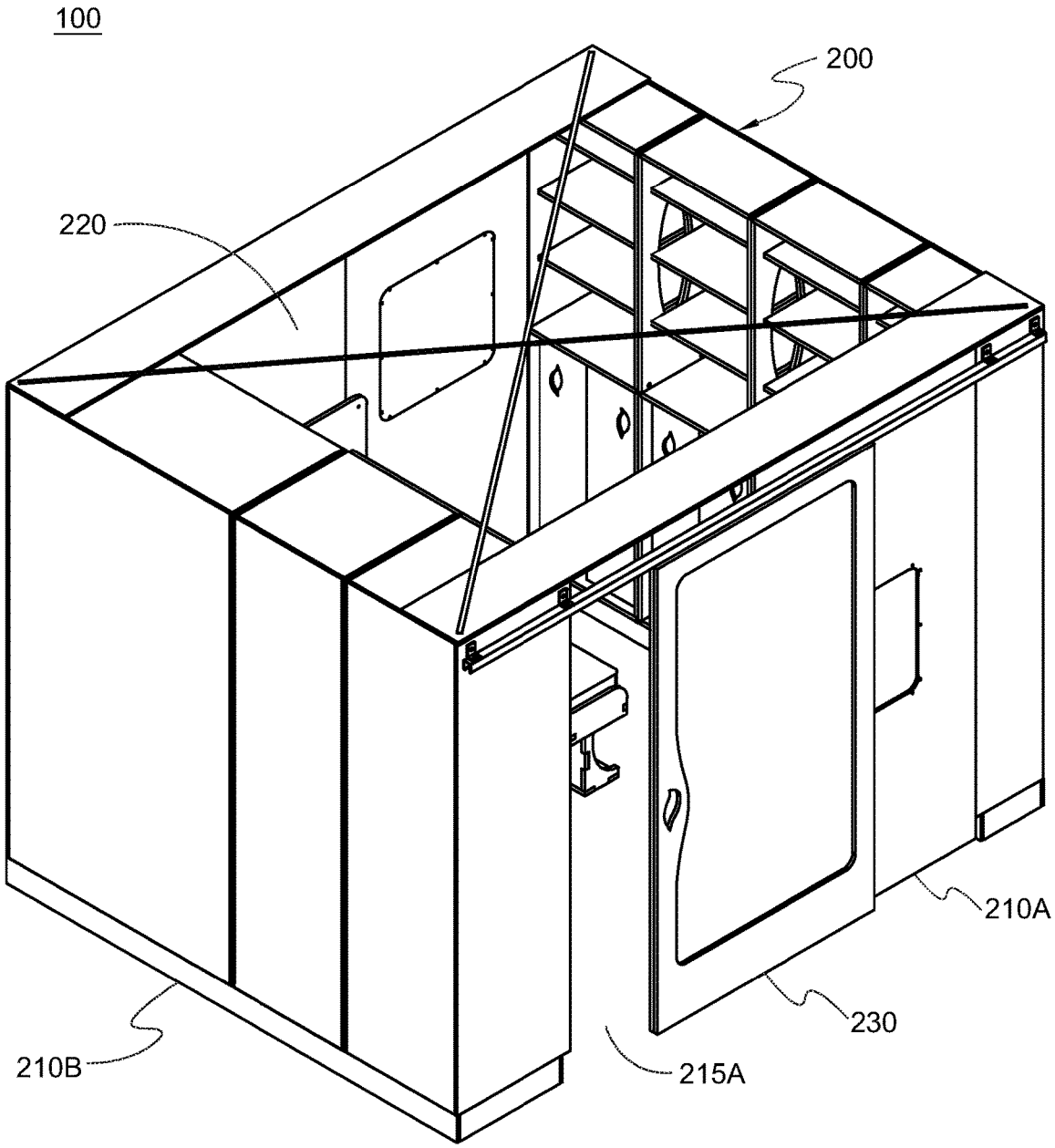

Turning to FIGS. 1A-B, the reentry transitional housing system 100 advantageously can provide a pre-fabricated modular room, creating a private and dignified space to rest and call home. Re-envisioning a living component of supportive housing, the reentry transitional housing system 100 can balance the traditional high cost of construction and support the volume of men and women who are reentering their communities from prison, jail or other form of incarceration. The reentry transitional housing system 100 thereby can provide a more cost-effective and dignified solution emerged that would provide these men and women with the privacy and spatial support that they need in the form of refuge rooms 200.

The reentry transitional housing system 100 can include one or more modular refuge rooms 200 as illustrated in FIGS. 1A-B. Each refuge room 200 can be configured to providing living quarters for a selected individual occupant (not shown). In selected embodiments, the selected individual occupant can comprise an individual, including man and/or a woman, who is reentering a community after release from prison, jail or other form of incarceration.

As shown in FIGS. 1A-B, for example, a selected refuge room 200 can comprise one or more folding panels, walls or other physical side barrier members 210 that can enclose or otherwise define an internal refuge room space 220 within the refuge room 200. In other words, the side barrier members 210 that can define a perimeter around the internal refuge room space 220 of the refuge room 200. The side barrier members 210 preferably can be insulated, such as against sound. In selected embodiments, a variety of side barrier members 210 may be available, for example, with various textures and/or decorative designs. The internal space 220 within the refuge room 200 can be provided with any suitable characteristics such as a size, shape or other dimension. The characteristics of the refuge room 200 can be based, for instance, upon one or more needs or other requirements of the selected individual occupant.

In selected embodiments, the refuge room 200 can comprise a rectangular refuge room with a plurality of side barrier members 210. As illustrated in FIGS. 1A-B, for example, the refuge room 200 can comprise a first side barrier member 210A, a second side barrier member 210B, a third side barrier member 210C and a fourth side barrier member 210D. Each of the side barrier members 210A-D is shown as including a first end region 212A and a second end region 212B. The second end region 212B of each respective side barrier member 210A-D preferably is opposite the first end region 212A of the relevant side barrier member 210A-D.

Adjacent side barrier members 210 can be coupled to form the refuge room 200. As shown in FIGS. 1A-B, end regions 212 of adjacent side barrier members 210 can be coupled. The first end region 212A of the first side barrier member 210A can be coupled with the first end region 212A of the second side barrier member 210B; whereas, the second end region 212B of the first side barrier member 210A can be coupled with the first end region 212A of the third side barrier member 210C. Similarly, the first end region 212A of the fourth side barrier member 210D can be coupled with the second end region 212B of the second side barrier member 210B; whereas, the second end region 212B of the fourth side barrier member 210D can be coupled with the second end region 212B of the third side barrier member 210C. The side barrier members 210A-D can be coupled via one or more fasteners (not shown), such as a screw, a dowel rod and/or a nail, an adhesive and/or a glue, without limitation.

The side barrier members 210 can be formed from any suitable natural and/or synthetic material, such as plastic, foam, wood (including plywood) and/or a composite material. If the refuge room 200 is formed from plywood, for example, the plywood can be cut to size on a computer numerical control (or CNC) machine. In selected embodiments, the refuge room 200 can be formed from wood with a polyurethane finish, which can be cleaned with a dry or damp cloth, and preferably is kept free of excessive moisture to avoid mold or warping of the wood while in use or in storage. The side barrier material can be uniform or different among the side barrier members 210. For example, the side barrier material can be selected by trauma informed design and preferably does not replicate materials found in the infrastructure of the carceral system, such as metal.

In selected embodiments, one or more of the side barrier members 210 can define at least one opening 215, such as a refuge room doorway (or portal) opening 215A (shown in FIG. 1C) and/or a refuge room window 215B. Each opening 215 advantageously can communicate with the internal refuge room space 220 of the refuge room 200. One or more of the openings 215 can comprise an unfilled void in the relevant side barrier member 210, and/or at least one selected opening 215, such as the refuge room window 215B, can be filled with a shatterproof transparent and/or translucent material (not shown), such as acrylic, Plexiglas or other suitable materials. The transparent and/or translucent material can be fixed in the selected opening 215 and/or can be openable or otherwise adjustable to permit air to circulate within the refuge room 200 via the selected opening 215. The openings 215 advantageously can be utilized to provide illumination within the internal refuge room space 220 of the refuge room 200 and/or to permit the individual occupant within the internal refuge room space 220 with a view outside of the refuge room 200. As desired, at least one of the openings 215 can be associated with a curtain or other window covering (not shown).

As illustrated in FIG. 1A, the refuge room portal opening 215A can be provided within a selected side barrier member 210, such as the first side barrier member 210A, and/or between adjacent side barrier members 210. Stated somewhat differently, the refuge room portal opening 215A can be defined between the first and second end regions 212A, 212B of the first side barrier member 210A. The first side barrier member 210A, in selected embodiments, can comprise a first member section 214 and a second member section 216, wherein the refuge room portal opening 215A optionally can be defined as being between the first and second member sections 214, 216. The second member section 216 can be separate from, or at least partially integrated with, the first member section 214. The refuge room portal opening 215A can permit the individual occupant with ingress into, and egress from, the internal refuge room space 220 with a view outside of the refuge room 200.

The refuge room 200 can include an optional refuge room door 230. The refuge room door 230, for example, can be disposed adjacent to the refuge room portal opening 215A. The refuge room door 230 can be translatable or otherwise horizontally movable relative to the relevant side barrier member(s) 210. In other words, the refuge room door 230 can be adjustably coupled with the relevant side barrier member(s) 210. A position of the refuge room door 230 thereby can be adjustable relative to the refuge room portal opening 215A to provide, for example, additional air circulation within the refuge room 200 and/or a view outside of the refuge room 200.

The refuge room door 230, for example, can be moved between a first (or open) door position and a second (or closed) door position. In the first door position, the refuge room door 230 can permit access to the internal refuge room space 220 of the refuge room 200 via the refuge room portal opening 215A. The refuge room door 230 alternatively can inhibit access to the internal refuge room space 220 of the refuge room 200 via the refuge room portal opening 215A in the second door position. The refuge room door 230, when disposed in the second position, can block the refuge room portal opening 215A and thus enclose the internal refuge room space 220. The refuge room door 230 optionally can include a lock (not shown) for securing the refuge room door 230 in the closed position to restrict access to the internal refuge room space 220.

As shown in FIG. 1A, the refuge room door 230 can be adjustably coupled with the first side barrier member 210A via a door track apparatus 218. The door track apparatus 218 is shown as spanning a width of the first side barrier member 210A and can permit the refuge room door 230 to translate relative to the first side barrier member 210A. If the first side barrier member 210A comprises the first and second member sections 214, 216, the door track apparatus 218 can span both of the first and second member sections 214, 216. The door track apparatus 218 advantageously can enable the refuge room door 230 to be movable in a series of incremental (or successive) door positions between the first door position and the second door position. The refuge room door 230 thereby can be disposed in an intermediate door position that permits air or light into the internal refuge room space 220 via the refuge room portal opening 215A while inhibiting individuals from entering the internal refuge room space 220.

In selected embodiments, the refuge room door 230 can define one or more door openings 235, such as a door window 235A. The door window 235A, for example, can be provided in the manner set forth above with reference to the refuge room window 215B. Each door opening 235 can comprise an unfilled void in the room door 230 and/or can be filled with a transparent and/or translucent material, such as glass, acrylic, Plexiglas or other suitable materials. The door opening 235 advantageously can be utilized to provide illumination within the internal refuge room space 220 within the refuge room 200 and/or to permit the individual occupant within the internal refuge room space 220 with a view outside of the refuge room 200. The transparent and/or translucent material can be fixed in the door opening 235 and/or can be openable or otherwise adjustable to permit air to circulate within the refuge room 200 via the door opening 235. As desired, the door opening 235 can be associated with a curtain or other window covering (not shown).

Although shown and described with reference to FIGS. 1A-C as including a single refuge room portal opening 215A, the refuge room can include any predetermined number of refuge room portal openings 215A. If the refuge room 200 includes more than one refuge room portal opening 215A, some or all of the refuge room portal openings 215A can be associated with a respective refuge room door 230 provided in the manner described herein.

Figure 2A:
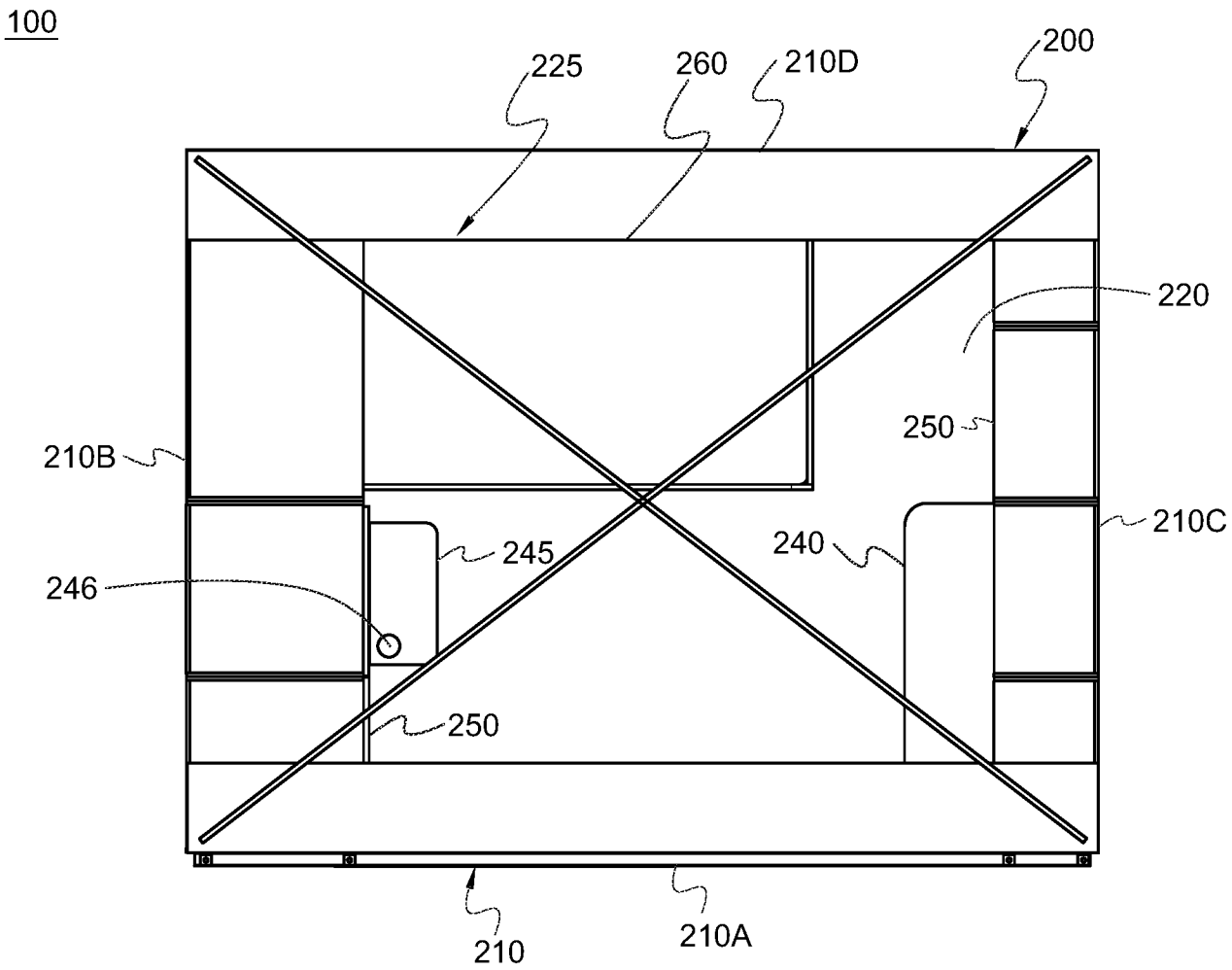
FIGS. 2A-C are detail diagrams illustrating an exemplary embodiment of an internal refuge room space of the refuge room of FIGS. 1A-C, wherein the internal refuge room space includes one or more furniture components.
Figure 2B:
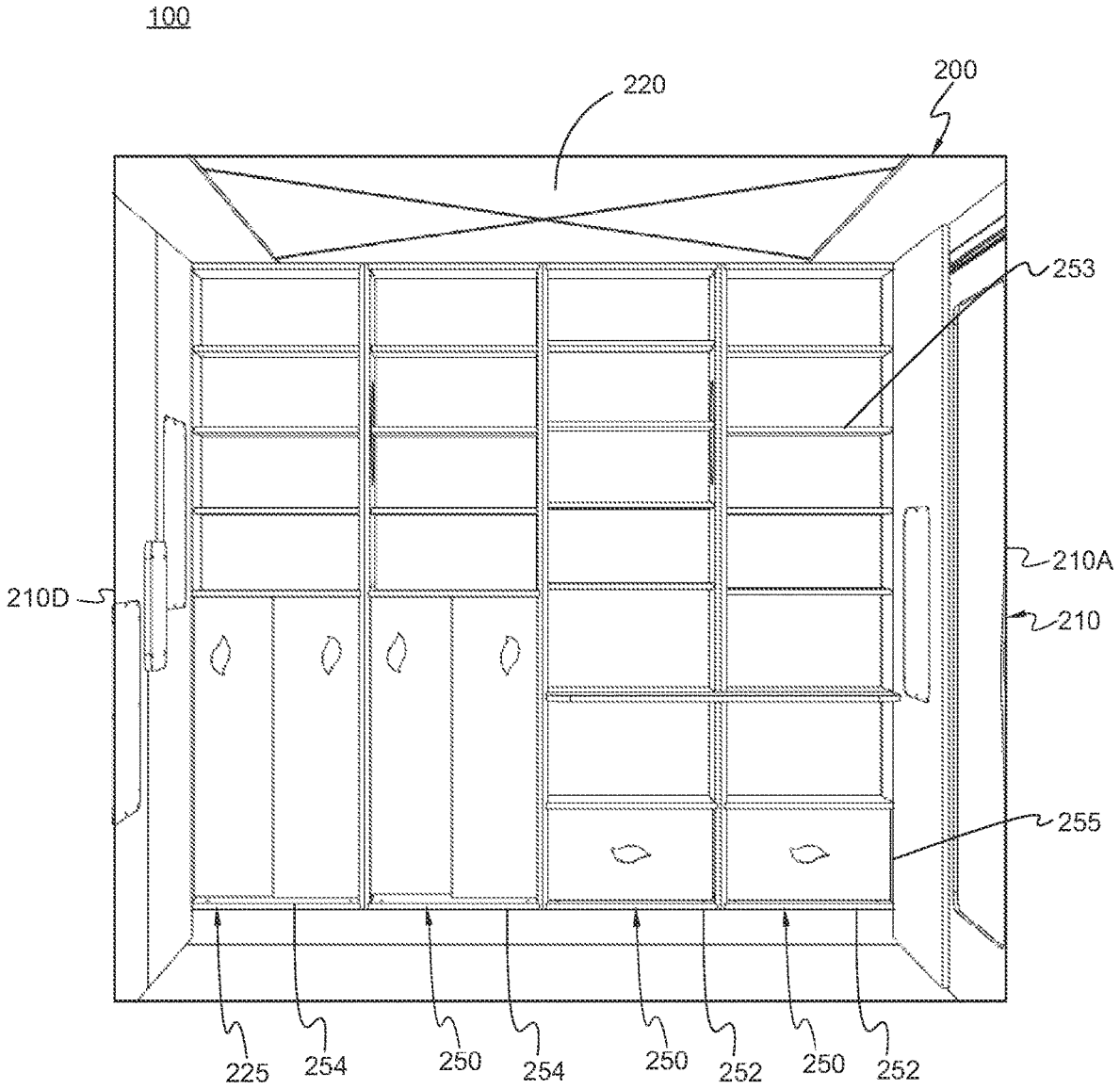
Figure 2C:
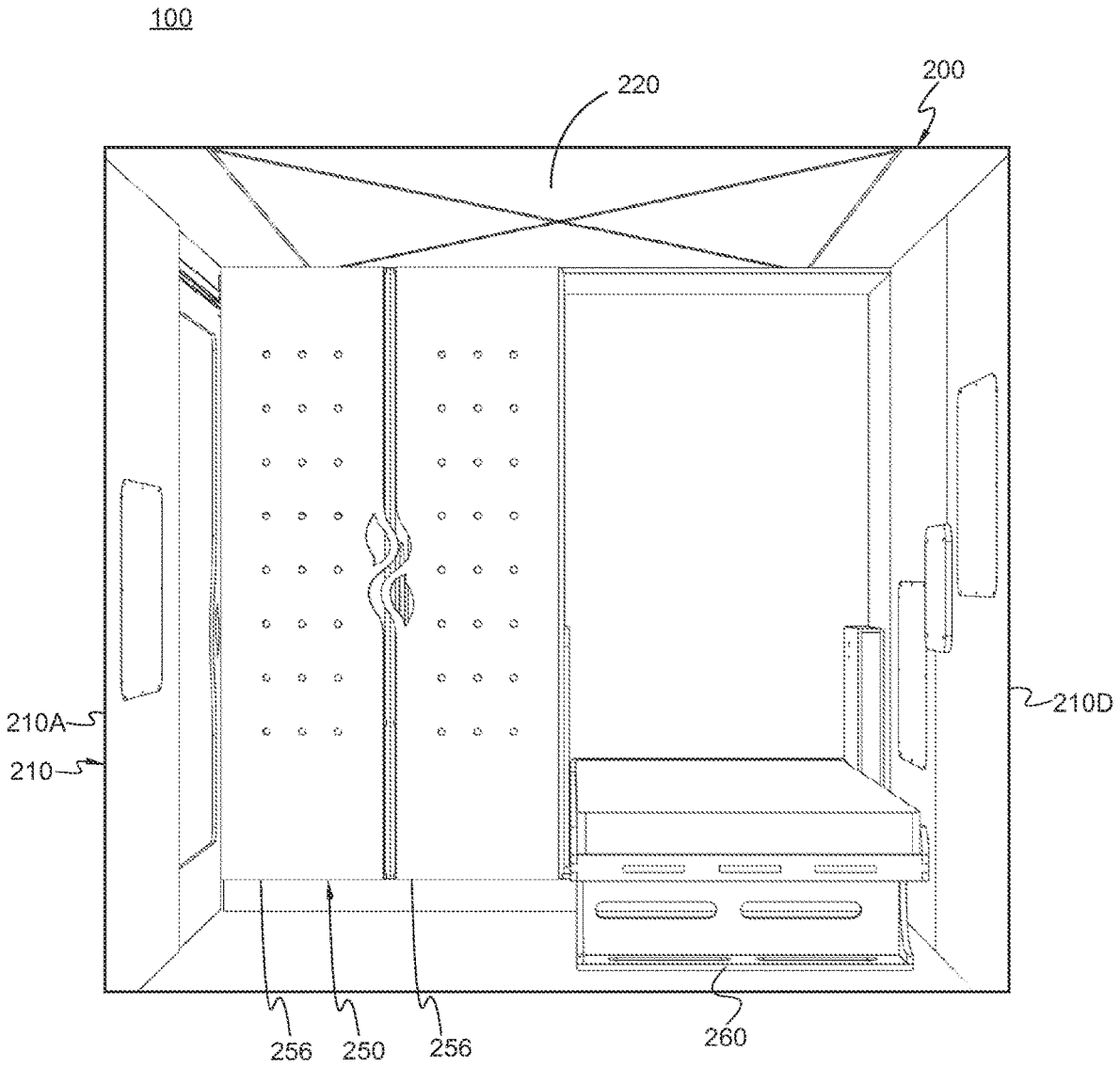

The refuge room 200 advantageously can include one or more furniture components 225 as illustrated in FIGS. 2A-C. The furniture components 225 can be disposed within the internal refuge room space 220 defined by the refuge room 200 and/or can at least partially extend outside of the refuge room 200. In selected embodiments, one or more of the furniture components 225 can be integrated with a selected side barrier member 210. At least one other furniture component 225 optionally can be separate from the side barrier members 210. As shown in FIG. 2A, exemplary furniture components 225 can include, but are not limited to, at least one desk 240, one or more storage components 250, and/or a bed 260.

The desk 240 of FIG. 2A can comprise any flat accessible, usable surface. The desk 240 can be at least partially integrated (or built into) a relevant side barrier member 210 and/or can be separate from the side barrier members 210 in the manner set forth above. In selected embodiments, the desk 240 can be removably coupled with the side barrier member 210 so that the desk 240 can be stowed when not in use. The desk 240, for example, can be stowed in a selected storage component 250 when not in use. Additionally and/or alternatively, the desk 240 can be retractable within the side barrier member 210 so that the desk 240 can be retracted into the side barrier member 210 when not in use.

The storage components 250 can provide storage for clothing, valuables and other personal items of the individual occupant. Each storage component 250 can be disposed adjacent to a selected side barrier member 210. In selected embodiments, the storage components 250 can be at least partially integrated (or built into) a relevant side barrier member 210 and, very preferably can comprise the side barrier member 210. More than one side barrier member 210 can be associated with the storage components 250 and/or more than one storage component 250 can be associated with a selected side barrier member 210 as shown in FIGS. 2A-C.

In selected embodiments, the refuge room 200 can include a cup holder 245 with a flat accessible, usable surface that defines a cup holder opening 246 for receiving and holding a beverage container. The cup holder 245 advantageously can be coupled with another furniture component 225. As shown in FIG. 2A, for example, the cup holder 245 can be coupled with a selected storage component 250, such as a closet door of a closet 256 (shown in FIG. 2C). If disposed adjacent to the bed 260, the cup holder 245 advantageously can provide a nightstand for use by a refuge room occupant while utilizing the bed 260. The cup holder 245 can be adjustable coupled with the closet door so that the cup holder 245 can be stowed when not in use. For example, the cup holder 245 can be folding down when not in use.

Turning to FIG. 2B, for example, the storage components 250 can include at least one bookcase 252 with at least one optional drawer 255 and/or at least one cabinet 254 with one or more closing doors, without limitation. In selected embodiments, one or more of the shelves 253 of the bookcase 252 can be movable, enabling the shelves 253 to be moved out of the way when not in use. FIG. 2C illustrates that the storage components 250 can include at least one closet 256.

One or more of the cabinets 254 and/or one or more of the closets 256 can include a lockable door. The cabinets 254 and/or closets 256 thereby can provide secure, locking storage for any valuables or other property of the individual occupant. In selected embodiments, a single storage component 250 can span a width of the selected side barrier member 210 and/or multiple storage components 250 can be positioned side-by-side along the width of the selected side barrier member 210 as illustrated in FIG. 2B.

As illustrated in FIG. 2C, the refuge room 200 can include one or more beds 260. Each bed 260 can be disposed proximately to, distally from, a selected side barrier member 210 and/or preferably can provided with a view of the portal 215 and/or the door 230. The bed 260, for example, can be at least partially integrated (or built into) a relevant side barrier member 210. Stated somewhat differently, the bed 260 can span a width of the selected side barrier member 210 and/or the bed 260 and at least one storage component 250 can be positioned side-by-side along the width of the selected side barrier member 210 as illustrated in FIG. 2C. In selected embodiments, the bed 260, either alone or in combination with one or more storage component 250, can comprise the side barrier member 210.

Additionally and/or alternatively, the bed 260 can be provided as a wall bed, a pull-down bed, a fold-down bed or any other kind of retractable bed to avoid consuming significant internal space 220 when not in use. The bed 260, for example, can be hinged at one end region for vertical storage against the selected side barrier member 210. In selected embodiments, the bed 260 advantageously can be configured for storage inside a closet or cabinet, such as the cabinet 256.

Although shown and described with reference to FIGS. 2A-C as including the desk 240, the storage components 250 and the bed 260 for purposes of illustration only, the refuge room 200 can include any predetermined number, combination and type of the furniture components, as desired. The furniture components 225 of the refuge room 200 advantageously can be customized for any specific need or use of an intended individual occupant. In selected embodiments, installed furniture components 225 of the refuge room 200 can be readily exchanged or otherwise replaced, for example, if damaged, if a current occupant of the refuge room 200 has new needs and/or if a new occupant is moving into the refuge room 200. The refuge room 200, in other words, can be adapted to meet one or more personal preferences of an intended occupant of the refuge room 200. The refuge rooms 200 thereby can enable the intended occupant to customize the refuge rooms 200 to meet any personal preferences.

The refuge room 200, for example, can include a foldable table (not shown), at least one foldable chair and/or other furniture (not shown), a compartment (not shown) for dirty clothes, a compartment (not shown) for hanging clothes, electrical power, a portable heating and/or cooling device (not shown), one or more fixed, portable and/or controllable lighting fixtures (not shown), Wireless Fidelity (Wi-Fi) or other internet access and/or a room location (not shown) for displaying photographs, pictures or other artwork, without limitation. In selected embodiments, a selected furniture component can serve multiple functions. The selected furniture component, for example, can provide a seating function and/or a storage function. In selected embodiments, each refuge room 200 can include one or more electrical outlets and/or one or more data ports, such as a Universal Serial Bus (or USB) port. Preferably comprising basic living units with access to common sinks, lavatories, showers and other facilities within an operating environment 120 (shown in FIG. 7) of the refuge room 200, the refuge rooms 200 optionally can include at least one plumbing, water and/or sewage hook-up.

In the manner set forth above with reference to FIGS. 2A-C, one or more of the side barrier members 210 of the refuge room 200 can comprise at least one of the furniture components 225. Stated somewhat differently, at least one of the side barrier members 210 can be formed from one or more furniture components 225. Selected furniture components 225, in selected embodiments, can be coupled to form the side barrier member 210 as a continuous side barrier member. In other words, the side barrier member 210 includes no gaps between adjacent furniture components 225 to help ensure privacy for the refuge room occupant. The furniture components 225 can be coupled in any conventional manner such as, for example, via one or more nails, screws or other fasteners.

Figure 3C:
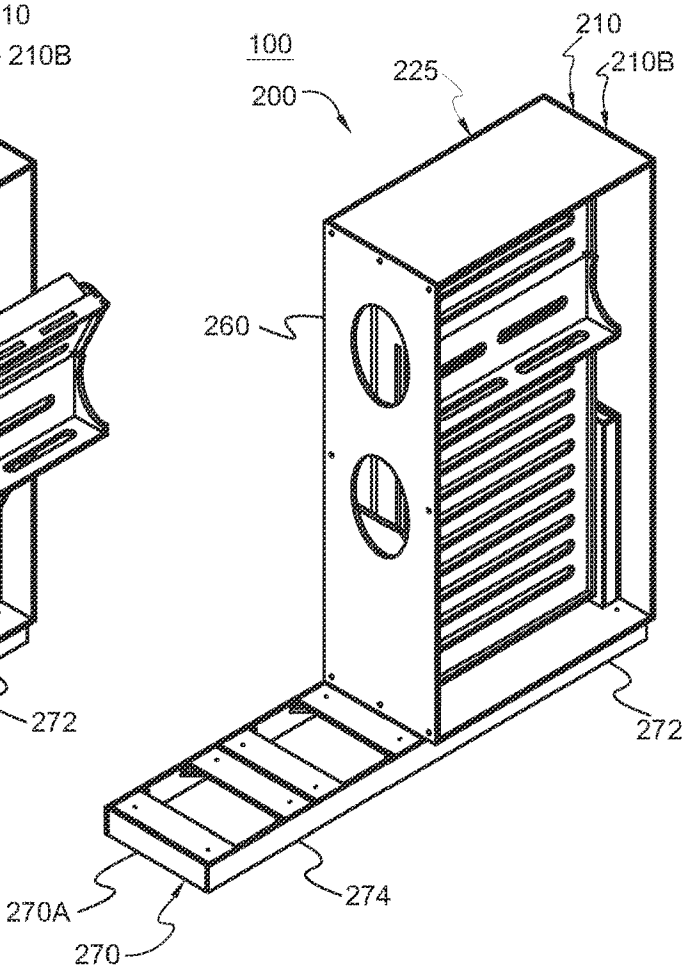
FIGS. 3A-F are detail diagrams illustrating an exemplary embodiment of the refuge room of FIGS. 2A-C, wherein a first selected side barrier member of the refuge room comprises at least one of the furniture components.
Figure 3B:
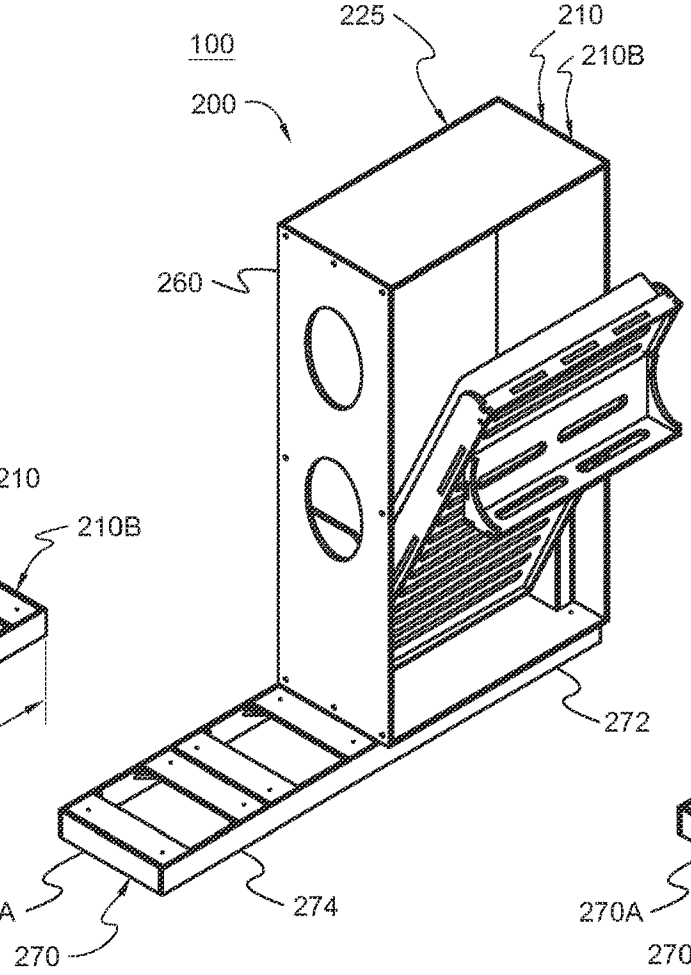
Figure 3A:
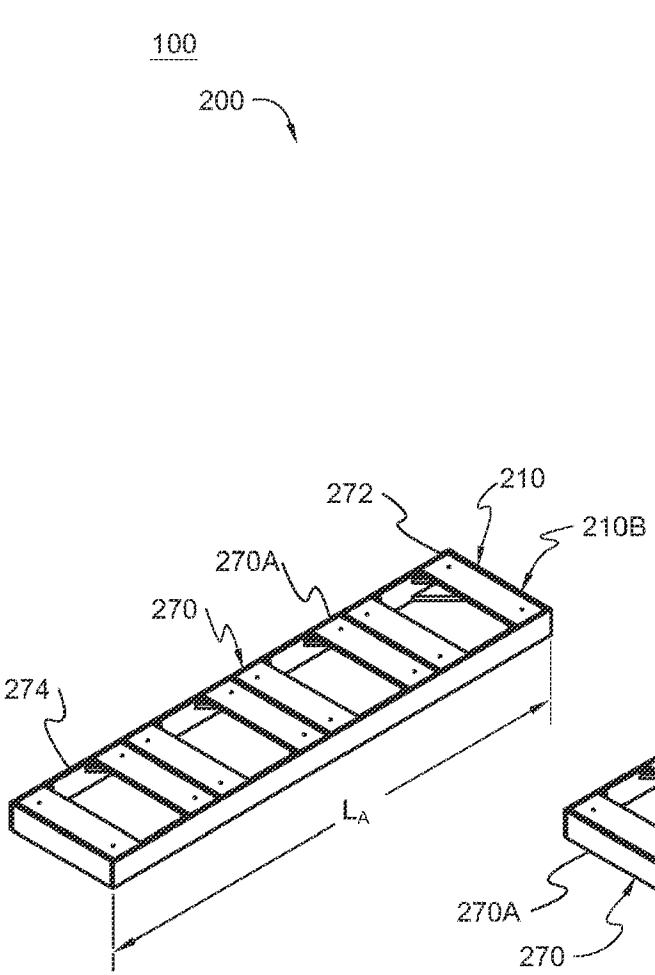

The second side barrier member 210B, for example, can comprise the bed 260, either alone or in combination with one or more other furniture components 225, as shown in FIGS. 3A-F. In selected embodiments, the bed 260 and any other furniture components 225 can be disposed upon, and supported by, a side barrier base member 270. Turning to FIG. 3A, the second side barrier member 210B can include a first side barrier base member 270A. The first side barrier base member 270A can have first and second end regions 272, 274 and a first predetermined length LA. The first side barrier base member 270A can provide a foundation for the second side barrier member 210B and support the bed 260 and/or the other furniture components 225. Stated somewhat differently, the first side barrier base member 270A can comprise an interface between the bed 260 and/or the other furniture components 225 and a floor (not shown) of an operating environment 120 (shown in FIG. 7) of the refuge room 200.

The bed 260 can be disposed on a selected portion of the first side barrier base member 270A as illustrated in FIGS. 3B-C. Turning to FIG. 3B, the selected portion, for example, can comprise the proximal end region 272 of the first side barrier base member 270A. The bed 260 can span the entire first side barrier base member 270A or, as shown in FIGS. 3B-C, can partially span the first side barrier base member 270A. The bed 260 can be coupled with the first side barrier base member 270A via one or more fasteners or any other conventional manner.

If the bed 260 partially spans the first side barrier base member 270A, one or more other furniture components 225 can be disposed on the first side barrier base member 270A. Turning to FIG. 3D, for example, a first closet 256 can be disposed on the first side barrier base member 270A. The first closet 256 can be disposed adjacent to the bed 260 on the first side barrier base member 270A as shown in FIG. 3D. In selected embodiments, the first closet 256 can be disposed at the distal end region 274 of the first side barrier base member 270A and/or, as shown in FIG. 3D, between the proximal end region 272 and the distal end region 274.

The first closet 256 preferably abuts the bed 260 when disposed on the first side barrier base member 270A to form the second side barrier member 210B as a continuous side barrier member 210. In other words, the second side barrier member 210B includes no gaps between any adjacent furniture components 225 to help ensure privacy for the refuge room occupant. Additionally and/or alternatively, the first closet 256 can be coupled with the first side barrier base member 270A and/or the bed 260, for example, via one or more fasteners, such nails or screws, or any other conventional manner.

Additionally and/or alternatively, one or more additional furniture components 225 can be disposed upon the first side barrier base member 270A such that the furniture components 225 span the first side barrier base member 270A. Adjacent furniture components 225 preferably abut in the manner set forth above, forming the second side barrier member 210B as a continuous side barrier member 210 between the proximal end region 272 and the distal end region 274. Stated somewhat differently, the second side barrier member 210B can include no gaps between any adjacent furniture components 225 to help ensure privacy for the refuge room occupant.

Figure 3F:
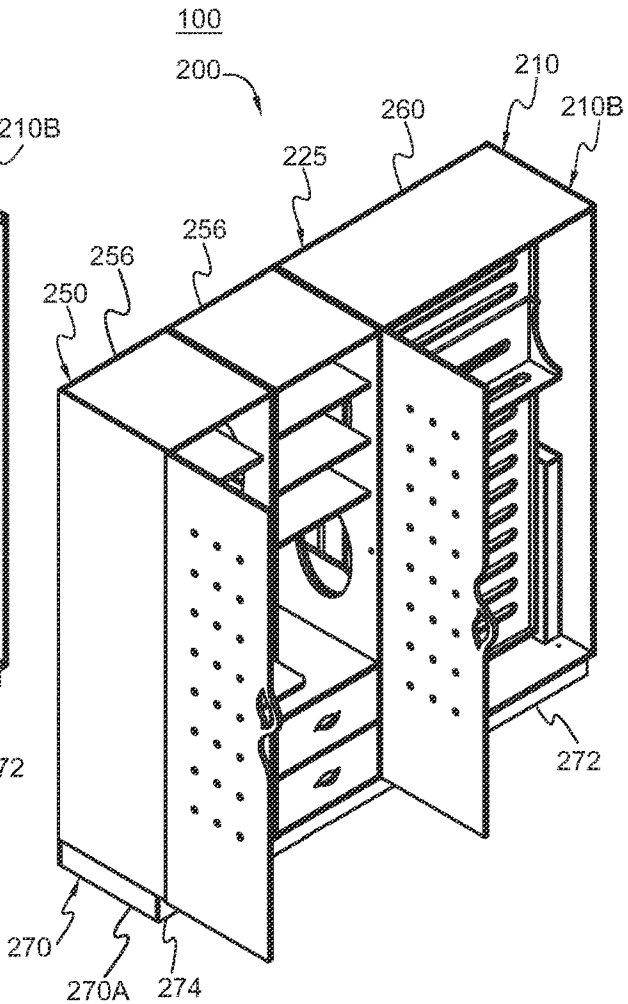
Figure 3E:
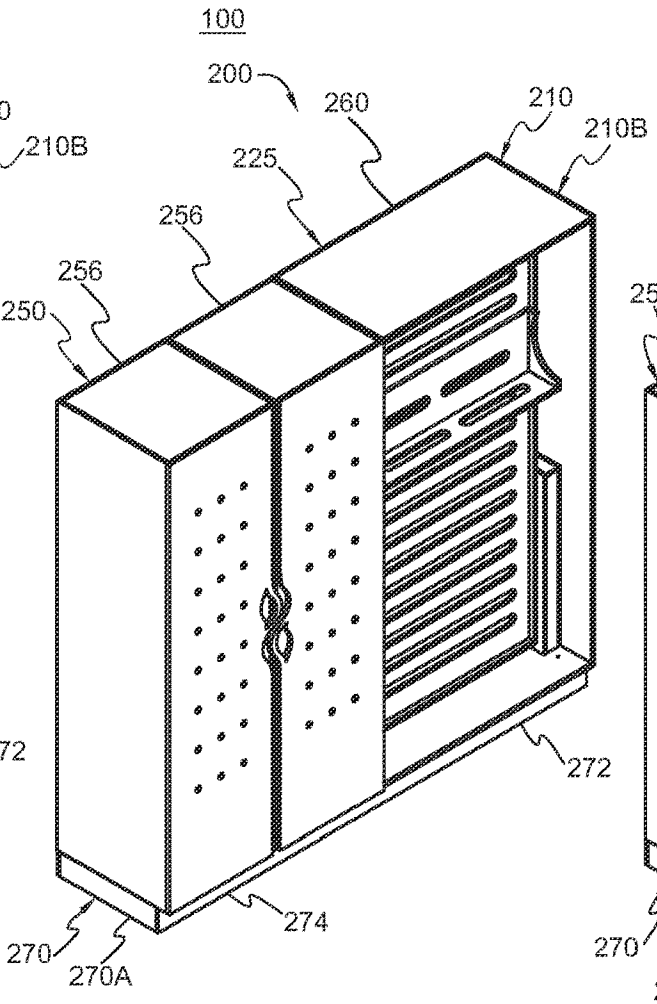
Figure 3D:
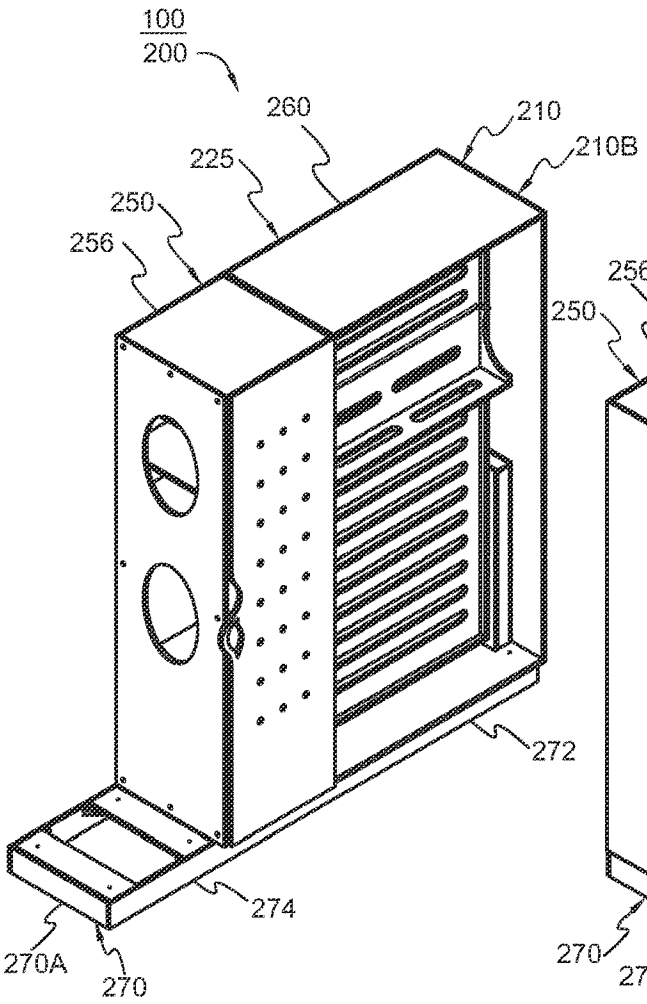

A second closet 256, for example, can be disposed on the first side barrier base member 270A as shown in FIGS. 3E-F. As shown in FIGS. 3E-F, the second closet 256 can be disposed adjacent to the first closet 256 on the first side barrier base member 270A. In selected embodiments, the second closet 256 can be disposed between the proximal end region 272 and the distal end region 274 and/or at a distal end region 274 of the first side barrier base member 270A in the manner illustrated in FIGS. 3E-F.

The second closet 256 preferably abuts the first closet 256 when disposed on the first side barrier base member 270A to form the second side barrier member 210B as a continuous side barrier member 210. In other words, the second side barrier member 210B includes no gaps between any adjacent furniture components 225 to help ensure privacy for the refuge room occupant. The bed 260, first closet 256 and the second closet 256 are shown as spanning the proximal end region 272 and the distal end region 274 of the first side barrier base member 270A, completing the second side barrier member 210B. Additionally and/or alternatively, the second closet 256 can be coupled with the first side barrier base member 270A and/or the first closet 256, for example, via one or more fasteners, such nails or screws, or any other conventional manner.

The furniture components 225 that comprise a selected side barrier member 210 of the refuge room 200 can be uniform and/or different. Additionally and/or alternatively, the furniture components 225 included in the second side barrier member 210B can be the same as, or different from, the furniture components 225 included in the third side barrier member 210C.

Turning to FIGS. 4A-F, the third side barrier member 210C can comprise one or more storage components 250 or other furniture components 225. The third side barrier member 210C can include a second side barrier base member 270B. The second side barrier base member 270B can have first and second end regions 272, 274 and a second predetermined length $L_B$. Although preferably equal to the first side barrier base member 270A (collectively shown in FIG. 3A), the second predetermined length $L_B$ optionally can be greater than or less than the first predetermined length $L_A$ of the first side barrier base member 270A. Advantageously, the second side barrier base member 270B can provide a foundation for the third side barrier member 210C and support the storage components 250 and/or the other furniture components 225. Stated somewhat differently, the second side barrier base member 270B can comprise an interface between the storage components 250 and/or the other furniture components 225 and the floor (not shown) of the operating environment 120 (shown in FIG. 7).

Figure 4C:
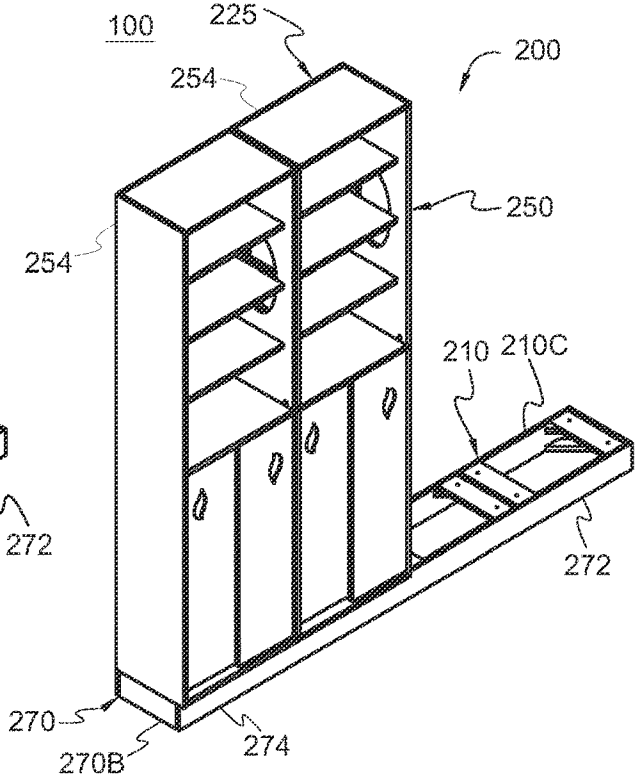
FIGS. 4A-F are detail diagrams illustrating an alternative exemplary embodiment of the refuge room of FIGS. 2A-C, wherein a second selected side barrier member of the refuge room comprises at least one of the furniture components.
Figure 4B:
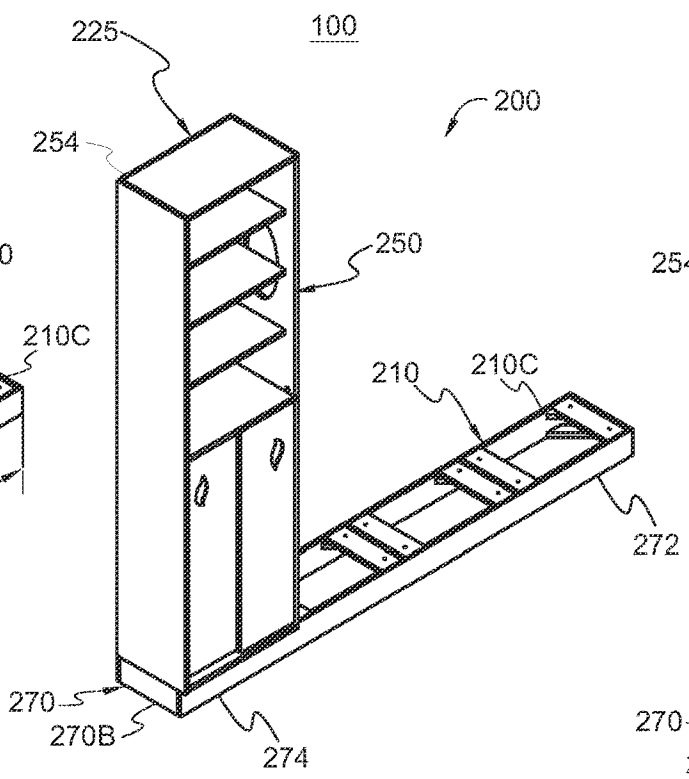
Figure 4A:
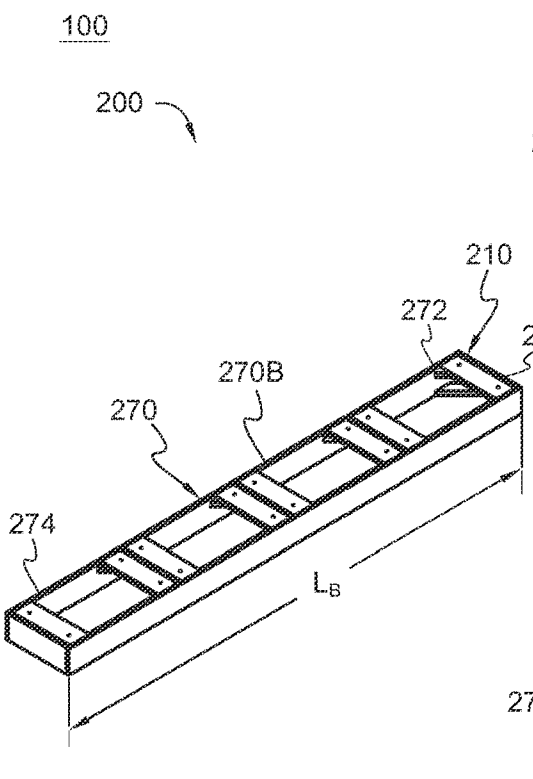

The storage components 250 associated with the third side barrier member 210C can include a first cabinet 254. The first cabinet 254 can be disposed on a selected portion of the second side barrier base member 270B as shown in FIG. 4B. Turning to FIG. 4B, the selected portion, for example, can comprise a distal end region 274 of the second side barrier base member 270B. The first cabinet 254 can span the entire second side barrier base member 270B or, as shown in FIG. 4B, can partially span the second side barrier base member 270B. The first cabinet 254 can be coupled with the second side barrier base member 270B via one or more fasteners or any other conventional manner.

If the first cabinet 254 partially spans the second side barrier base member 270B, one or more other furniture components 225 can be disposed on the second side barrier base member 270B in the manner discussed in more detail above with reference to FIGS. 3A-F. Turning to FIG. 4C, for example, a second cabinet 254 can be disposed on the second side barrier base member 270B. The second cabinet 254 can be disposed adjacent to the first cabinet 254 on the second side barrier base member 270B as shown in FIG. 4C. In selected embodiments, the second cabinet 254 can be disposed at a proximal end region 272 of the second side barrier base member 270B and/or, as shown in FIG. 4C, between the proximal end region 272 and the distal end region 274.

The second cabinet 254 preferably abuts the first cabinet 254 when disposed on the second side barrier base member 270B to form the third side barrier member 210C as a continuous side barrier member 210 in the manner described in more detail above with reference to the second side barrier member 210C of FIGS. 3A-F. In other words, the third side barrier member 210C includes no gaps between any adjacent furniture components 225 to help ensure privacy for the refuge room occupant. Additionally and/or alternatively, the second cabinet 254 can be coupled with the second side barrier base member 270B and/or the first cabinet 254, for example, via one or more fasteners, such nails or screws, or any other conventional manner.

Additionally and/or alternatively, one or more additional furniture components 225 can be disposed upon the second side barrier base member 270B such that the furniture components 225 span the second side barrier base member 270B. Adjacent furniture components 225 preferably abut in the manner set forth above, forming the third side barrier member 210C as a continuous side barrier member 210 between the proximal end region 272 and the distal end region 274. Stated somewhat differently, the third side barrier member 210C can include no gaps between any adjacent furniture components 225 to help ensure privacy for the refuge room occupant. In selected embodiments, the furniture components 225 can be constructed with respective predetermined widths based upon the second predetermined length $L_B$ of the second side barrier base member 270B.

One or more other additional furniture components 225 can be disposed on the second side barrier base member 270B if the first and second cabinets 254 partially span the second side barrier base member 270B. Turning to FIG. 4D, for example, a first bookcase 252 can be disposed on the second side barrier base member 270B. The first bookcase 252 can be disposed adjacent to the first and second cabinets 254 on the second side barrier base member 270B as shown in FIG. 4D. In selected embodiments, the first bookcase 252 can be disposed at a proximal end region 272 of the second side barrier base member 270B and/or, as shown in FIG. 4D, between the proximal end region 272 and the distal end region 274.

The first bookcase 252 preferably abuts the first and second cabinets 254 when disposed on the second side barrier base member 270B to form the third side barrier member 210C as a continuous side barrier member 210 in the manner described in more detail above with reference to the second side barrier member 210C of FIGS. 3A-F. In other words, the third side barrier member 210C includes no gaps between any adjacent furniture components 225 to help ensure privacy for the refuge room occupant. Additionally and/or alternatively, the first bookcase 252 can be coupled with the second side barrier base member 270B and/or the second cabinet 254, for example, via one or more fasteners, such nails or screws, or any other conventional manner.

Figure 4F:
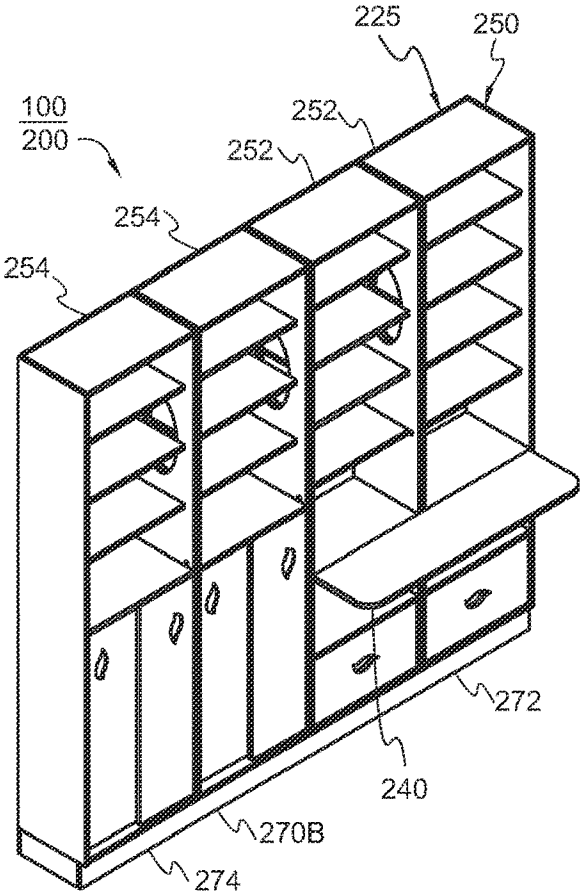
Figure 4E:
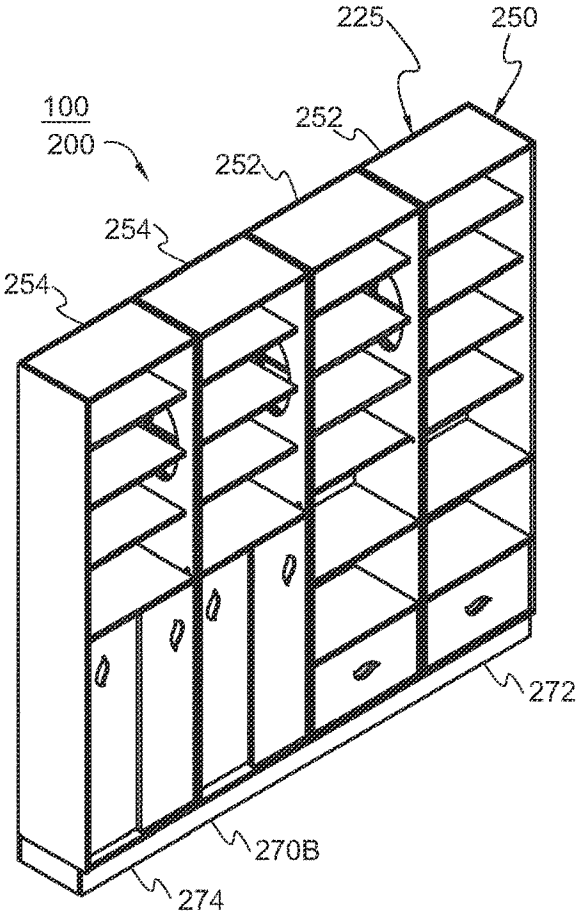
Figure 4D:
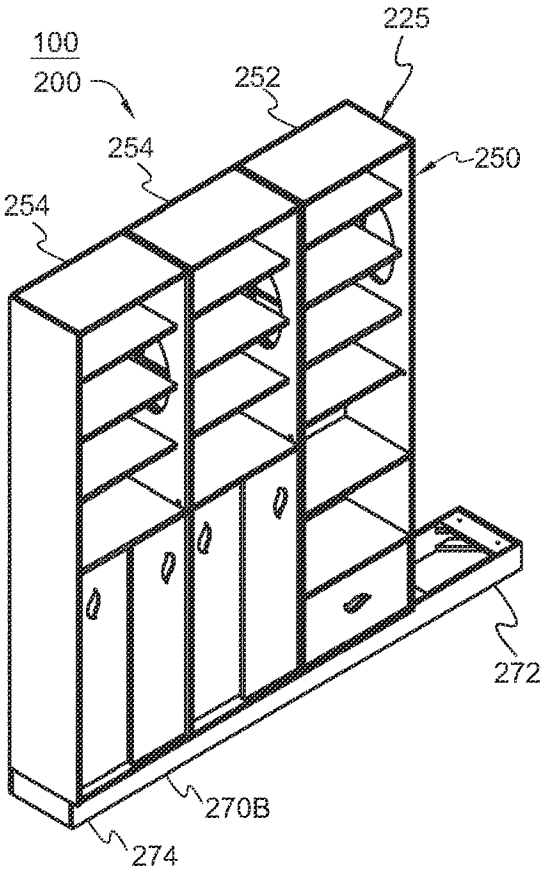

As shown in FIGS. 4E-F, a second bookcase 252 can be disposed on the second side barrier base member 270B. The second bookcase 252 can be disposed adjacent to the first bookcase 252 on the second side barrier base member 270B as illustrated in FIGS. 4E-F. In selected embodiments, the second bookcase 252 can be disposed between the proximal end region 272 and the distal end region 274 and/or at a proximal end region 272 of the second side barrier base member 270B as shown in FIGS. 4E-F.

An optional desk 240 can extend from the first bookcase 252 and/or the second bookcase 252 as illustrated in FIG. 4F. Stated somewhat differently, the desk 240 can be at least partially integrated (or built into), and/or separate from, the first bookcase 252 and/or the second bookcase 252 in the manner set forth above. The desk 240 can comprise any flat accessible, usable surface. In selected embodiments, the desk 240 can at least partially retractable into the first bookcase 252 and/or the second bookcase 252 as shown in FIG. 4E so that the desk 240 can be stowed when not in use.

The second bookcase 252 preferably abuts the first bookcase 252 when disposed on the second side barrier base member 270B to form the third side barrier member 210C as a continuous side barrier member 210. In other words, the third side barrier member 210C includes no gaps between any adjacent furniture components 225 to help ensure privacy for the refuge room occupant. The first and second cabinets 254 and the first and second bookcases 252 are shown as spanning the proximal end region 272 and the distal end region 274 of the second side barrier base member 270B, completing the third side barrier member 210C. Additionally and/or alternatively, the second bookcase 252 can be coupled with the second side barrier base member 270B and/or the first bookcase 252, for example, via one or more fasteners, such nails or screws, or any other conventional manner.

In selected embodiments, the furniture components 225 can be constructed with respective predetermined widths based upon the predetermined length, such as the first predetermined length $L_A$ or the second predetermined length $L_B$, of the side barrier base member 270. The furniture components 225 of the refuge room 200, in other words, can be provided in a modular manner such that installed furniture components 225 can be readily exchanged or otherwise replaced, for example, if damaged, if a current occupant of the refuge room 200 has new needs and/or if a new occupant is moving into the refuge room 200. A damaged cabinet 254, for example, can be replaced with a new cabinet 254. Additionally and/or alternatively, an installed cabinet 254 can be replaced with a bookcase 252, for instance, if the occupant possesses a large number of books.

Figure 5:
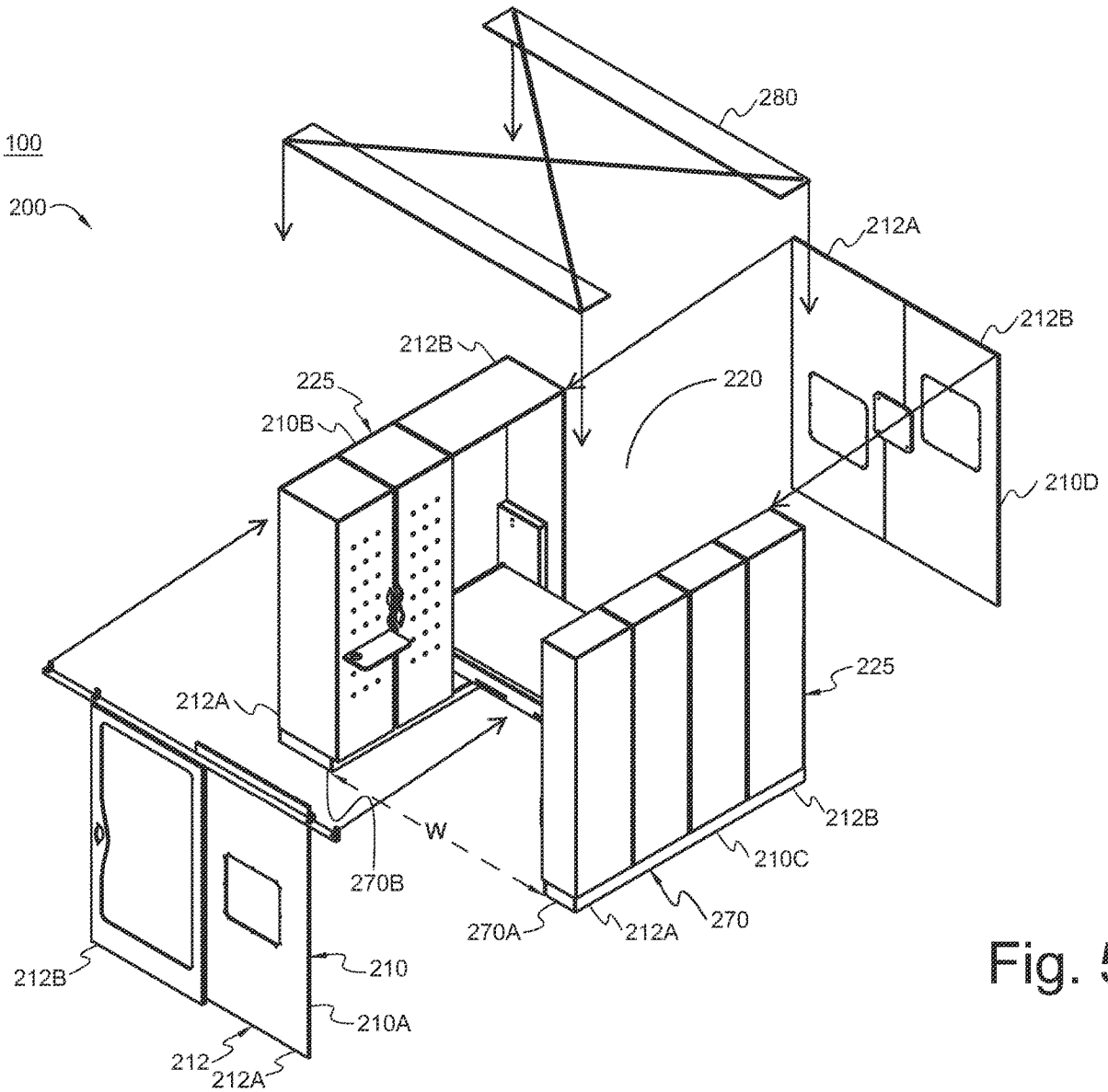
FIG. 5 is a detail diagram illustrating another alternative exemplary embodiment of the refuge room of FIGS. 2A-C, wherein the first selected side barrier member of FIGS. 3A-F and the second selected side barrier member of FIGS. 4A-F are coupled to form the refuge room.

In the manner discussed in more detail above with reference to the refuge room 200 of FIGS. 1A-C, the side barrier members 210 can be coupled to form the refuge room 200. The second side barrier member 210B of FIGS. 3A-F and the third side barrier member 210C of FIGS. 4A-F, for example, can be coupled via first and fourth side barrier members 210A, 210D as illustrated in FIG. 5. In selected embodiments, the first side barrier base member 270A of the second side barrier member 210B can be disposed at a first predetermined location of a floor (not shown) of the operating environment 120 (shown in FIG. 7). One or more one or more furniture components 225 can be assembled on the first side barrier base member 270A to form the second side barrier member 210B in the manner discussed in more detail above with reference to the second side barrier member 210B of FIGS. 3A-F.

The second side barrier base member 270B of the third side barrier member 210C can be disposed at a second predetermined location of the floor of the operating environment 120. The second predetermined location of the second side barrier base member 270B preferably is a preselected distance W from the first side barrier base member 270A of the second side barrier member 210B. One or more furniture components 225 can be assembled on the second side barrier base member 270B to form the third side barrier member 210C. Although shown and described as being formed by assembling furniture components 225 on spaced-apart side barrier base members 270 for purposes of illustration only, the second side barrier member 210B and/or the third side barrier member 210C can be assembled before being disposed on the floor of the operating environment 120.

Once the second side barrier member 210B and the third side barrier member 210C have been disposed at the respective first and second predetermined locations, the first side barrier member 210A can be disposed adjacent to the second side barrier member 210B and the third side barrier member 210C. As shown in FIG. 5, the first end region 212A of the first side barrier member 210A can be disposed adjacent to the first end region 212A of the second side barrier member 210B, whereas, the second end region 212B of the first side barrier member 210A can be disposed adjacent to the first end region 212A of the third side barrier member 210C. The first end region 212A of the first side barrier member 210A and the first end region 212A of the second side barrier member 210B can be coupled, and the second end region 212B of the first side barrier member 210A and the first end region 212A of the third side barrier member 210C can be coupled.

The fourth side barrier member 210D likewise can be disposed adjacent to the second side barrier member 210B and the third side barrier member 210C. The first end region 212A of the fourth side barrier member 210D can be disposed adjacent to the second end region 212B of the second side barrier member 210B, whereas, the second end region 212B of the fourth side barrier member 210D can be disposed adjacent to the second end region 212B of the third side barrier member 210C as illustrated in FIG. 5. Thereafter, the first end region 212A of the fourth side barrier member 210D and the second end region 212B of the second side barrier member 210B can be coupled, and the second end region 212B of the fourth side barrier member 210D and the second end region 212B of the third side barrier member 210C can be coupled.

To help ensure structural integrity of the refuge room 200, a metal strap cross brace 280 optionally can be placed across a top of the refuge room 200 and attached at the corners where adjacent side barrier members 210 meet. A pair of metal strap cross braces, for example, can diagonally span the refuge room 200 in an "X" formation as shown in FIG. 5.

In the manner set forth above, the side barrier members 210 can enclose or otherwise define the internal refuge room space 220 within the refuge room 200. The preselected distance W between the second side barrier member 210B and the third side barrier member 210C can help define a width of the internal refuge room space 220 within the refuge room 200. Additionally and/or alternative, a length of the internal refuge room space 220 within the refuge room 200 can be defined by the first predetermined length $L_A$ of the first side barrier base member 270A of the second side barrier member 210B and/or the second predetermined length $L_B$ of the second side barrier base member 270B of the third side barrier member 210C.

Figure 6A:
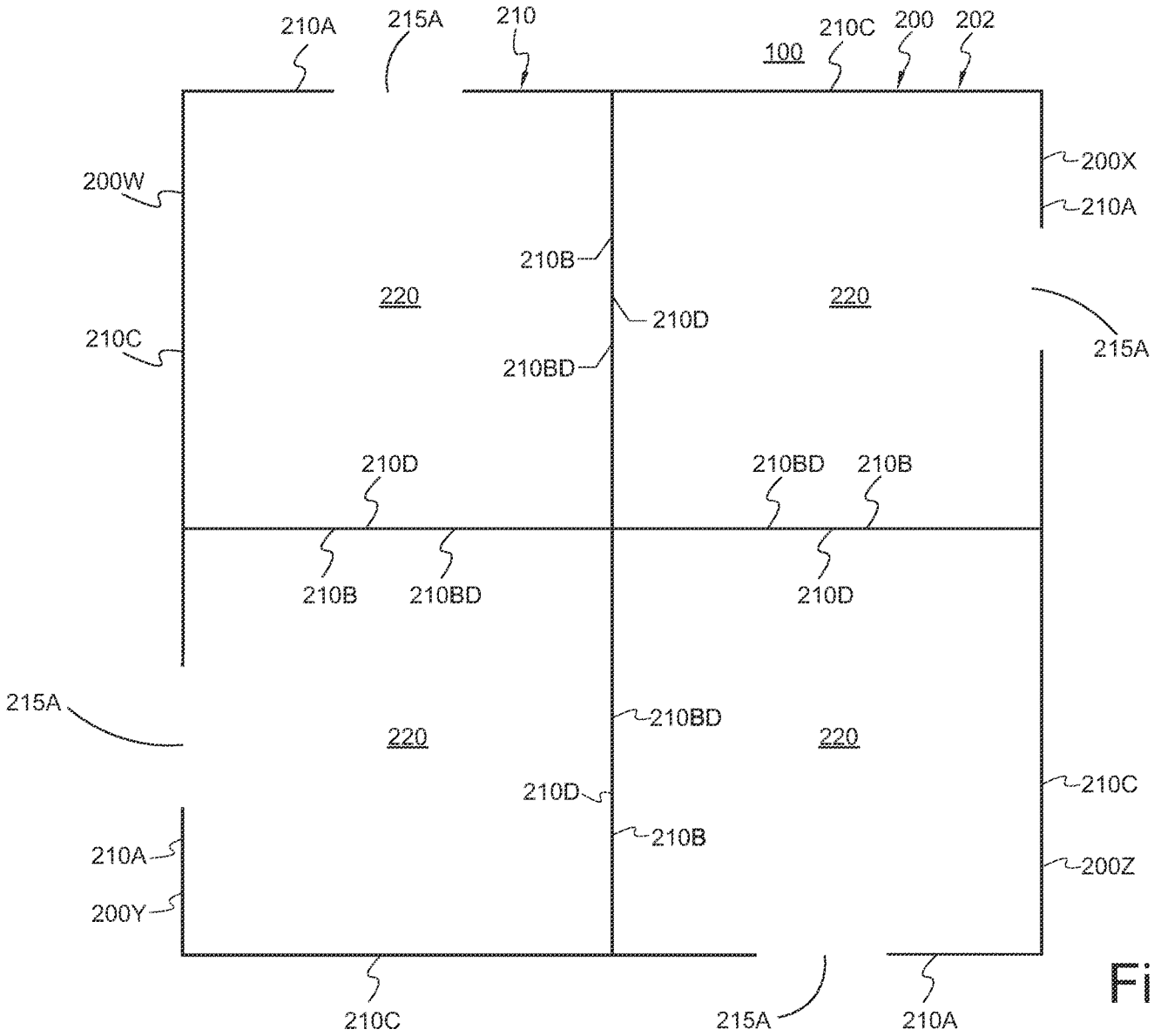
FIG. 6A is a detail diagram illustrating an exemplary embodiment of a refuge room cluster with more than one refuge room of FIGS. 1A-C.
Figure 6B:
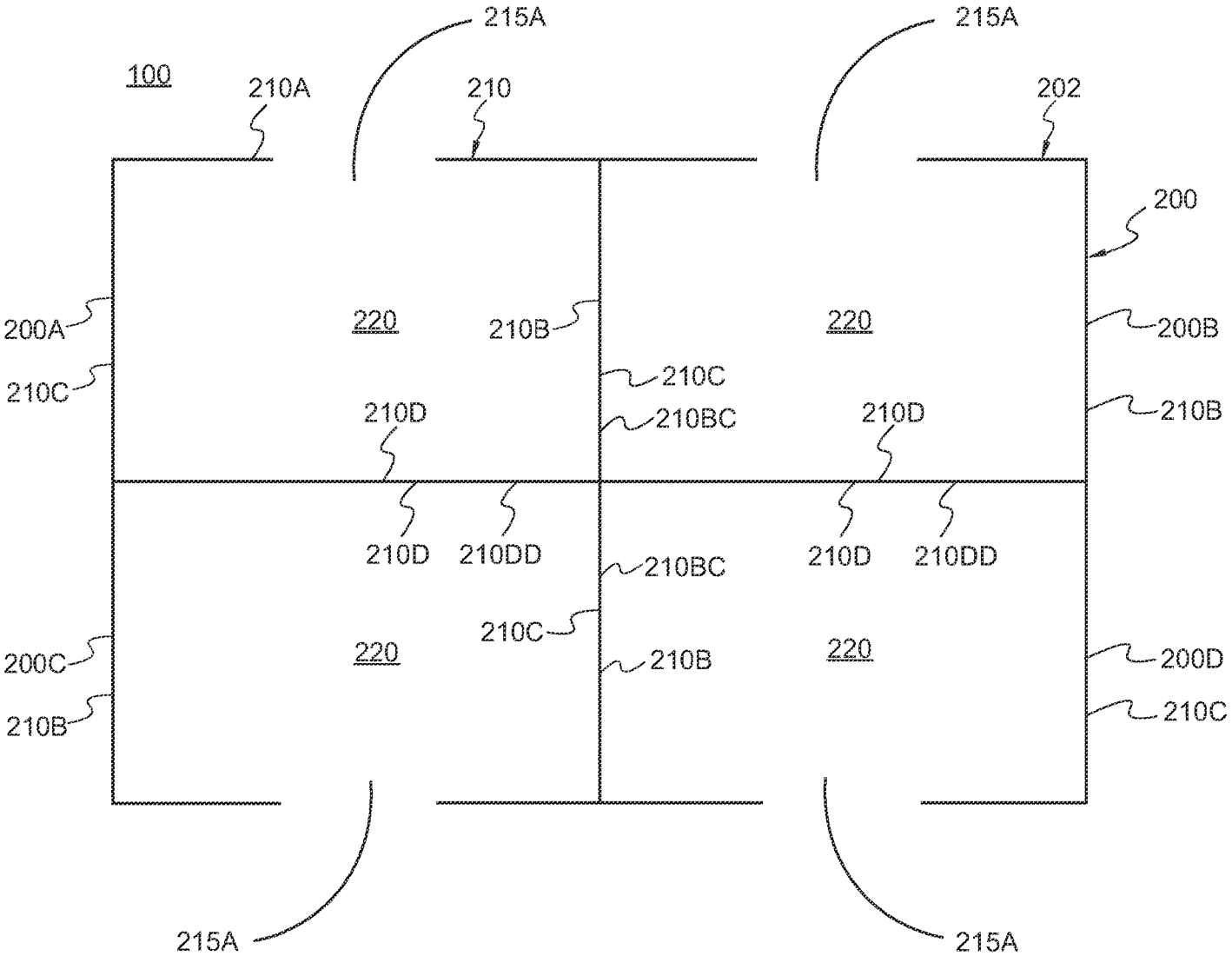
FIG. 6B is a detail diagram illustrating an alternative exemplary embodiment of a refuge room cluster of FIG. 6A, wherein refuge room portal openings of at least two of the refuge rooms are adjacently disposed.

In selected embodiments, one or more refuge rooms 200 can be grouped for provide a refuge room cluster 202 as shown in FIGS. 6A-B. Each refuge rooms 200 in the refuge room cluster 202 can be provided in the manner discussed above. An exemplary refuge room cluster 202 with a predetermined number of four refuge rooms 200 is shown in FIG. 6A. Each of the refuge rooms 200 comprises the side barrier members 210 for enclosing or otherwise defining the internal refuge room space 220 within the refuge room 200. As illustrated in FIG. 6A, adjacent refuge rooms 200 can share one or more common side barrier members 210, and the refuge room portal openings 215A of the adjacent refuge rooms 200 are disposed in different directions.

Turning to FIG. 6A, a first refuge room 200W is shown as being adjacent to a second refuge room 200X and sharing a common side barrier member 210BD. More specifically, the internal refuge room space 220 of the first refuge room 200W can be defined by the first side barrier member 210A, the second side barrier member 210B, the third side barrier member 210C and the fourth side barrier member 210D of the first refuge room 200W in the manner disclosed above with reference to the refuge room 200 of FIGS. 1A-C. The internal refuge room space 220 of the second refuge room 200X likewise can be defined by the first side barrier member 210A, the second side barrier member 210B, the third side barrier member 210C and the fourth side barrier member 210D of the second refuge room 200X in the manner set forth above with reference to the refuge room 200 of FIGS. 1A-C.

As shown in FIG. 6A, the second side barrier member 210B of the first refuge room 200W and the fourth side barrier member 210D of the second refuge room 200X can abut and form the common side barrier member 210BD. The second side barrier member 210B of the first refuge room 200W and the fourth side barrier member 210D of the second refuge room 200X can be provided as separate, adjacent side barrier members 210 as set forth above and/or can be merged into a composite side barrier member 210. If the second side barrier member 210B of the first refuge room 200W comprises at least one of the furniture components 225 in the manner described above with reference to FIGS. 3A-F, back regions of the furniture components 225 can provide the fourth side barrier member 210D of the second refuge room 200X.

The second refuge room 200X also is illustrated as being adjacent to a third refuge room 200Z and sharing a common side barrier member 210BD. Like the second refuge room 200X, the internal refuge room space 220 of the third refuge room 200Z can be defined by the first side barrier member 210A, the second side barrier member 210B, the third side barrier member 210C and the fourth side barrier member 210D of the third refuge room 200Z in the manner set forth above with reference to the refuge room 200 of FIGS. 1A-C. As illustrated in FIG. 6A, the second side barrier member 210B of the second refuge room 200X and the fourth side barrier member 210D of the third refuge room 200Z can abut and form the common side barrier member 210BD.

The second side barrier member 210B of the second refuge room 200X and the fourth side barrier member 210D of the third refuge room 200Z can be provided as separate, adjacent side barrier members 210 as set forth above and/or can be merged into a composite side barrier member 210. If the second side barrier member 210B of the second refuge room 200X comprises at least one of the furniture components 225 in the manner described above with reference to FIGS. 3A-F, back regions of the furniture components 225 can provide the fourth side barrier member 210D of the third refuge room 200Z.

As shown in FIG. 6A, the third refuge room 200Z can be adjacent to a fourth refuge room 200Y and sharing a common side barrier member 210BD. Like the third refuge room 200Z, the internal refuge room space 220 of the fourth refuge room 200Y can be defined by the first side barrier member 210A, the second side barrier member 210B, the third side barrier member 210C and the fourth side barrier member 210D of the fourth refuge room 200Y in the manner set forth above with reference to the refuge room 200 of FIGS. 1A-C. As illustrated in FIG. 6A, the second side barrier member 210B of the third refuge room 200Z and the fourth side barrier member 210D of the fourth refuge room 200Y can abut and form the common side barrier member 210BD.

The second side barrier member 210B of the third refuge room 200Z and the fourth side barrier member 210D of the fourth refuge room 200Y can be provided as separate, adjacent side barrier members 210 as set forth above and/or can be merged into a composite side barrier member 210. If the second side barrier member 210B of the third refuge room 200Z comprises at least one of the furniture components 225 in the manner described above with reference to FIGS. 3A-F, back regions of the furniture components 225 can provide the fourth side barrier member 210D of the fourth refuge room 200Y.

The first and fourth refuge rooms 200W, 200Y also are illustrated as being adjacent and sharing a common side barrier member 210BD. As shown in FIG. 6A, the second side barrier member 210B of the fourth refuge room 200Y and the fourth side barrier member 210D of the first refuge room 200W can abut and form the common side barrier member 210BD. The second side barrier member 210B of the fourth refuge room 200Y and the fourth side barrier member 210D of the first refuge room 200W can be provided as separate, adjacent side barrier members 210 as set forth above and/or can be merged into a composite side barrier member 210. If the second side barrier member 210B of the fourth refuge room 200Y comprises at least one of the furniture components 225 in the manner described above with reference to FIGS. 3A-F, back regions of the furniture components 225 can provide the fourth side barrier member 210D of the first refuge room 200W.

Although shown and described with reference to FIG. 6A as being provided in a square arrangement of four refuge rooms 200W-Z for purposes of illustration only, the refuge room cluster 202 can comprise any predetermined number of refuge rooms 200 and be disposed in any suitable configuration, including a single row of refuge rooms 200. Additionally and/or alternatively, the refuge room portal openings 215A of the adjacent refuge rooms 200 can be disposed in the same and/or different directions.

Turning to FIG. 6B, for example, the refuge room cluster 202 can include four refuge rooms 200A-D. Adjacent refuge rooms 200A, 200B can share a common side barrier member 210BC and have the refuge room portal openings 215A being disposed in a first direction. Adjacent refuge rooms 200C, 200D likewise can share a common side barrier member 210BC, and the refuge room portal openings 215A of the refuge rooms 200C, 200D can be disposed in a second direction.

More specifically, the internal refuge room space 220 of the first refuge room 200A can be defined by the first side barrier member 210A, the second side barrier member 210B, the third side barrier member 210C and the fourth side barrier member 210D of the first refuge room 200A in the manner disclosed above with reference to the refuge room 200 of FIGS. 1A-C. The internal refuge room space 220 of the second refuge room 200B likewise can be defined by the first side barrier member 210A, the second side barrier member 210B, the third side barrier member 210C and the fourth side barrier member 210D of the second refuge room 200X in the manner set forth above with reference to the refuge room 200 of FIGS. 1A-C.

As shown in FIG. 6B, the second side barrier member 210B of the first refuge room 200A and the third side barrier member 210C of the second refuge room 200X can abut and form the common side barrier member 210BC. The second side barrier member 210B of the first refuge room 200A and the fourth side barrier member 210D of the second refuge room 200X can be provided as separate, adjacent side barrier members 210 as set forth above and/or can be merged into a composite side barrier member 210.

If the second side barrier member 210B of the first refuge room 200A comprises at least one of the furniture components 225 in the manner described above with reference to FIGS. 3A-F and the third side barrier member 210C of the second refuge room 200B comprises at least one of the furniture components 225 in the manner described above with reference to FIGS. 4A-F, the side barrier base member 270 (shown in FIGS. 3A-F, 4A-F) can be configured to support the furniture components 225 for the second side barrier member 210B of the first refuge room 200A and the furniture components 225 for the third side barrier member 210C of the second refuge room 200B. The furniture components 225 associated the first refuge room 200A can face the internal refuge room space 220 of the first refuge room 200A; whereas, the furniture components 225 associated the second refuge room 200B can face the internal refuge room space 220 of the second refuge room 200B. In other words, back regions of the furniture components 225 associated the first refuge room 200A can abut back regions of the furniture components 225 associated the second refuge room 200B.

The internal refuge room spaces 220 of the third and fourth refuge rooms 200C, 200D similarly can be defined by the first side barrier member 210A, the second side barrier member 210B, the third side barrier member 210C and the fourth side barrier member 210D of the third and fourth refuge rooms 200C, 200D, respectively, in the manner disclosed above with reference to the refuge room 200 of FIGS. 1A-C. As shown in FIG. 6B, the second side barrier member 210B of the third refuge room 200C and the third side barrier member 210C of the second refuge room 200X can abut and form the common side barrier member 210BC. The second side barrier member 210B of the third refuge room 200C and the fourth side barrier member 210D of the second refuge room 200X can be provided as separate, adjacent side barrier members 210 as set forth above and/or can be merged into a composite side barrier member 210.

If the second side barrier member 210B of the third refuge room 200C comprises at least one of the furniture components 225 in the manner described above with reference to FIGS. 3A-F and the third side barrier member 210C of the fourth refuge room 200D comprises at least one of the furniture components 225 in the manner described above with reference to FIGS. 4A-F, the side barrier base member 270 (shown in FIGS. 3A-F, 4A-F) can be configured to support the furniture components 225 for the second side barrier member 210B of the third refuge room 200C and the furniture components 225 for the third side barrier member 210C of the fourth refuge room 200D. The furniture components 225 associated the third refuge room 200C can face the internal refuge room space 220 of the third refuge room 200C; whereas, the furniture components 225 associated the fourth refuge room 200D can face the internal refuge room space 220 of the fourth refuge room 200D. In other words, back regions of the furniture components 225 associated the third refuge room 200C can abut back regions of the furniture components 225 associated the fourth refuge room 200D.

As illustrated in FIG. 6B, the first refuge room 200A and the fourth refuge room 200D can share a common side barrier member 210DD. The fourth side barrier member 210D of the first refuge room 200A and the fourth side barrier member 210D of the fourth refuge room 200D can be provided as separate, adjacent side barrier members 210 as set forth above and/or can be merged into a composite side barrier member 210. In selected embodiments, a single fourth side barrier member 210D can be provided as the fourth side barrier member 210D for both the first and fourth refuge rooms 200A, 200D. In other words, one side of the fourth side barrier member 210D can define the internal refuge room space 220 within the first refuge room 200A and an opposite side of the fourth side barrier member 210D can define the internal refuge room space 220 within the fourth refuge room 200D.

The second refuge room 200B and the third refuge room 200C likewise can share a common side barrier member 210DD. The fourth side barrier member 210D of the second refuge room 200B and the fourth side barrier member 210D of the third refuge room 200C can be provided as separate, adjacent side barrier members 210 as set forth above and/or can be merged into a composite side barrier member 210. In selected embodiments, a single fourth side barrier member 210D can be provided as the fourth side barrier member 210D for both the second and third refuge rooms 200B, 200C. Stated somewhat differently, one side of the fourth side barrier member 210D can define the internal refuge room space 220 within the second refuge room 200B and an opposite side of the fourth side barrier member 210D can define the internal refuge room space 220 within the third refuge room 200C.

Although shown and described with reference to FIG. 6B as being provided in a rectangular arrangement of four refuge rooms 200A-D for purposes of illustration only, the refuge room cluster 202 can comprise a predetermined number of refuge rooms 200 within a recommended range and can be disposed in any suitable configuration, including a single row of refuge rooms 200.

Figure 7:
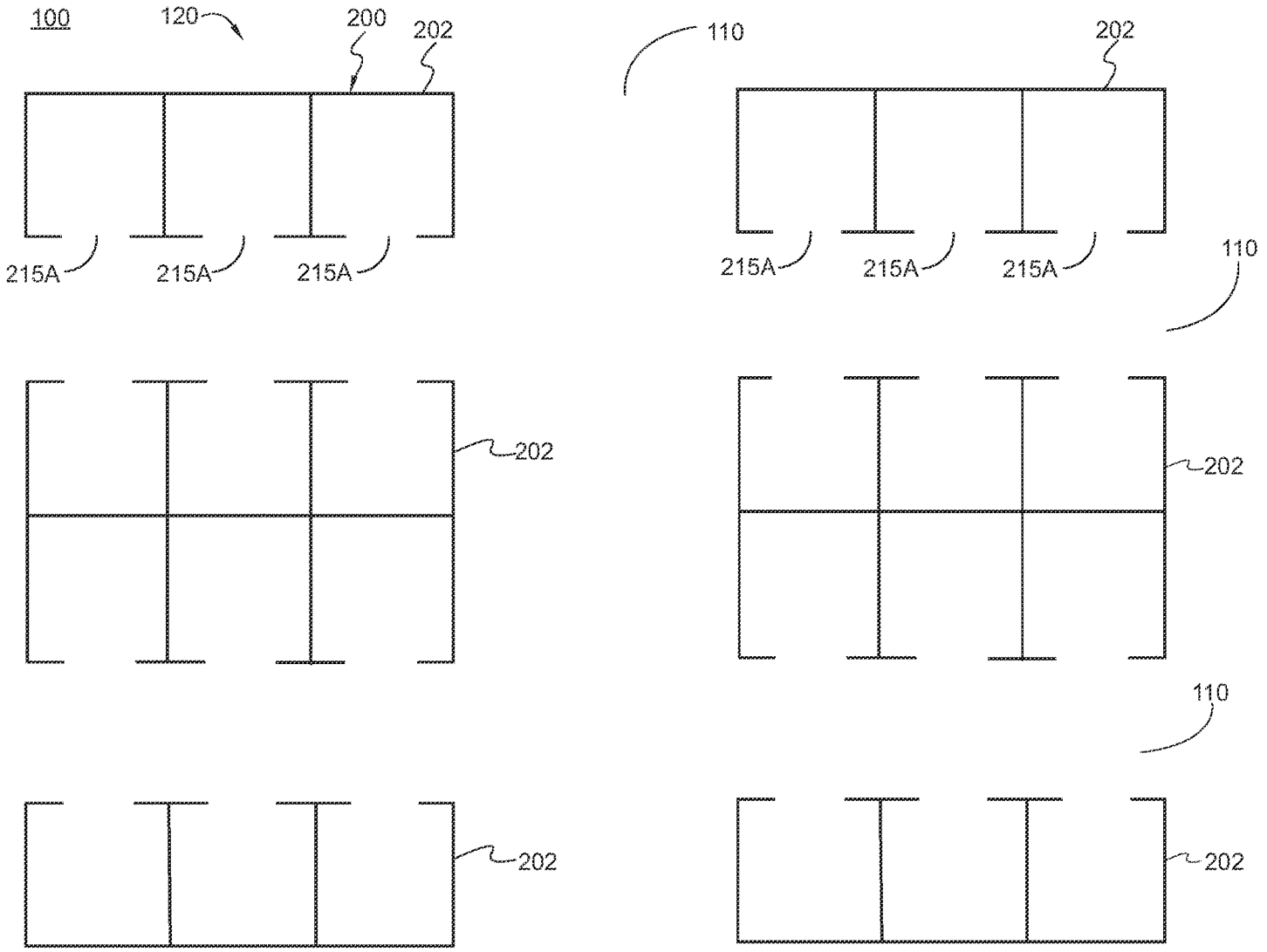
FIG. 7 is a detail diagram illustrating an exemplary embodiment of an operating environment for the refuge room of FIGS. 1A-C.

An exemplary operating environment 120 for the refuge room 200 is shown in FIG. 7. If the refuge room 200 includes no ceiling or other overhead member for covering the refuge room 200, the operating environment 120 can comprise an enclosed operating environment, such as environment, such as an auditorium, a gymnasium or a warehouse. Any predetermined number of refuge rooms 200 can be deployed at the operating environment 120. The refuge rooms 200 can include single (or unclustered) refuge rooms 200 and/or one or more refuge room clusters 202. The refuge room clusters 202 can be uniform and/or different. Stated somewhat differently, each refuge room cluster 202 can have a predetermined number of refuge rooms 200 that are arranged in a predetermined configuration that can be the same as, or different from, the number and configuration refuge rooms associated with one or more other refuge room clusters 202.

The operating environment 120 can provide one or more paths of travel, such as aisles 110, between the refuge rooms 200 and/or the refuge room clusters 202. The paths of travel optionally can include an access path for a common bathroom and other facilities and/or at least one ancillary area for a quiet zone and/or comfortable seating outside of the refuge rooms 200. The refuge rooms 200 and/or the refuge room clusters 202 thereby can be configured to accommodate a plurality of individual occupants. Although shown and described with reference to FIG. 7 as being deployed within an enclosed environment for purposes of illustration, the operating environment 120 can comprise any suitable location for assembling the refuge rooms 200, including enclosed (or indoor) environments and/or unenclosed (or outdoor) environments.

Figure 8A:
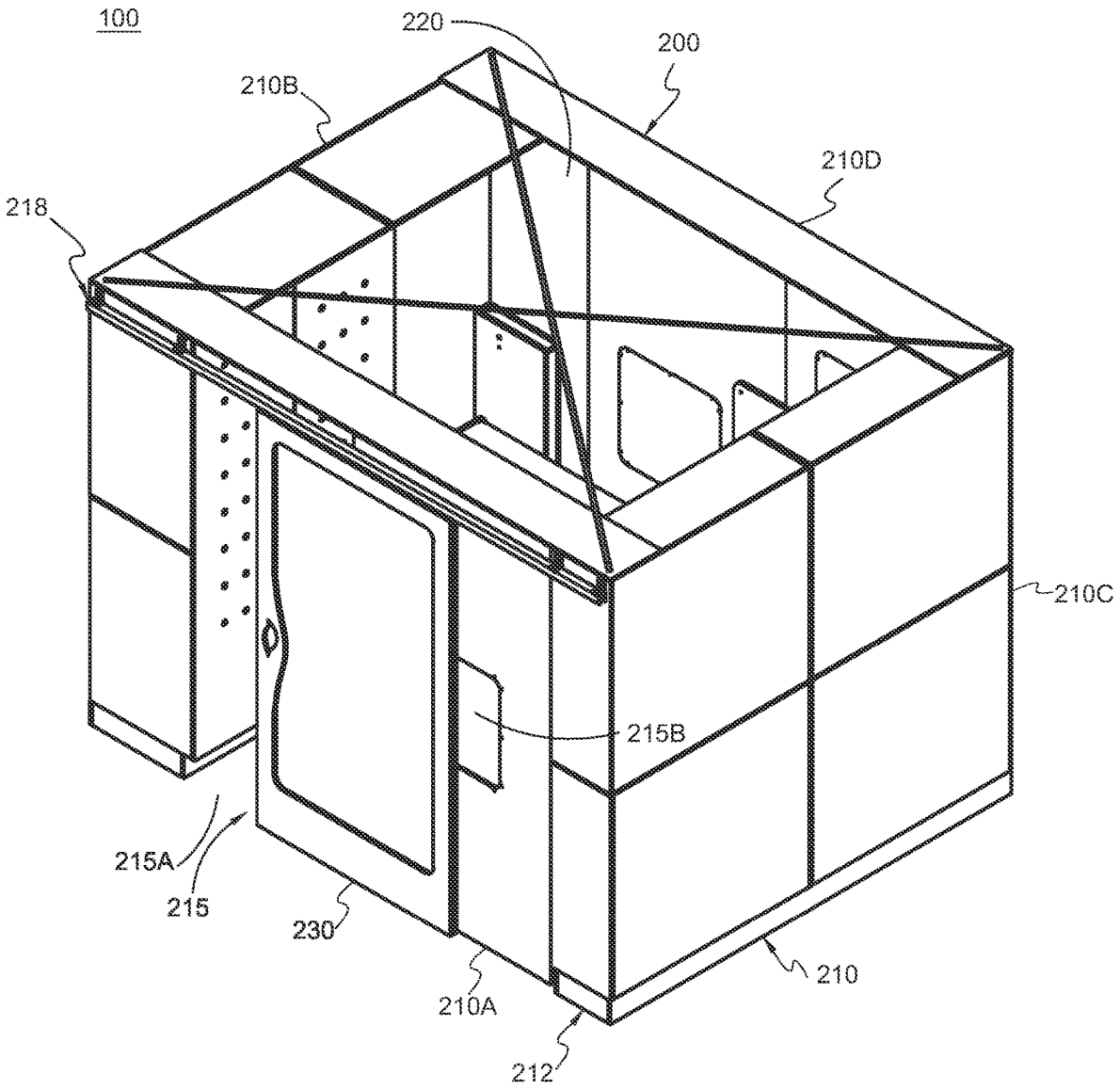
FIGS. 8A-B are detail diagrams illustrating an exemplary alternative embodiment of the refuge room of FIGS. 1A-C, wherein at least one of side barrier members includes one or more stackable side barrier members components.
Figure 8B:
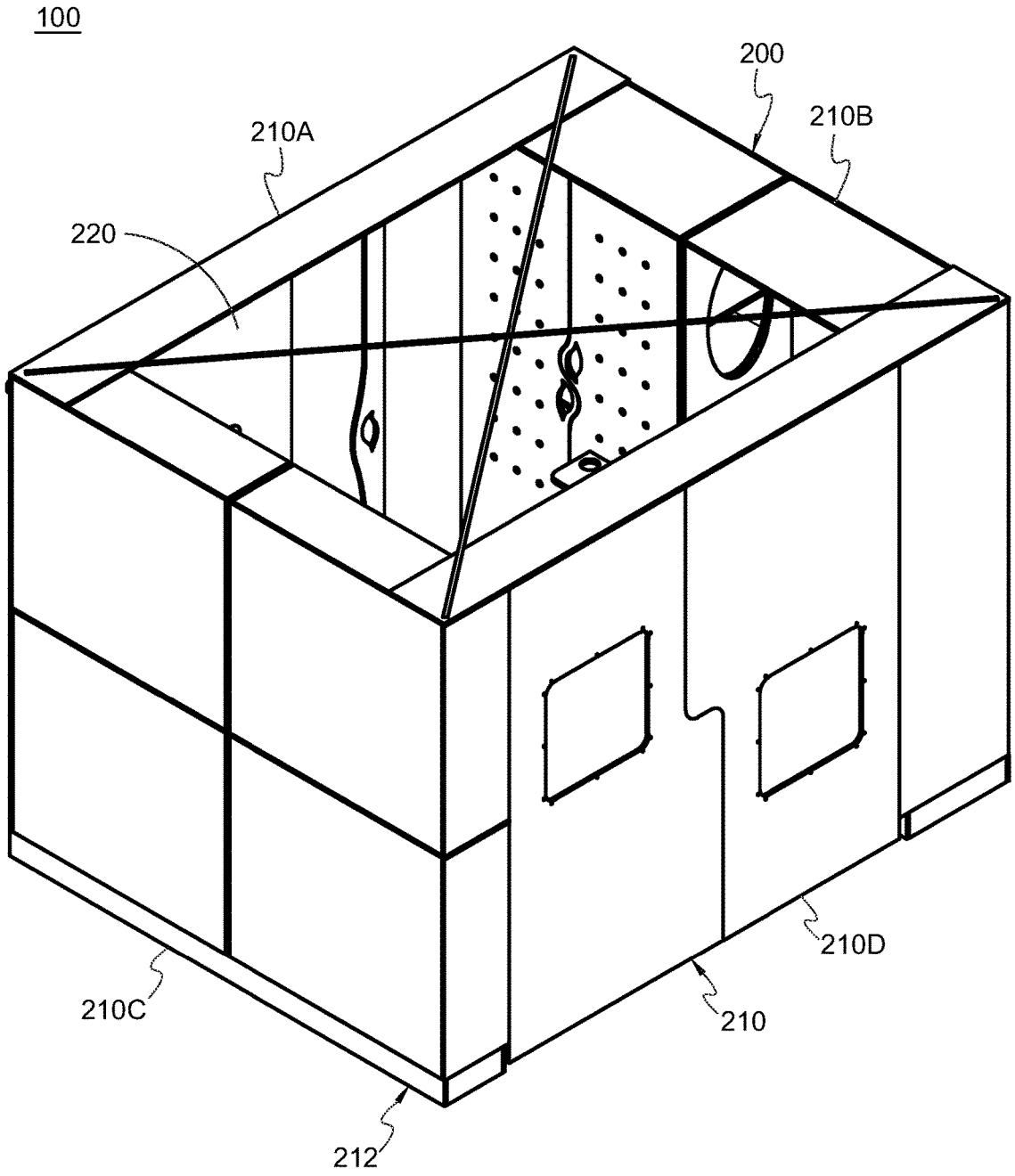

An alternative embodiment of the reentry transitional housing system 100 is shown in FIGS. 8A-B. The reentry transitional housing system 100 can include one or more refuge rooms 200 that can be provided in the manner set forth in more detail above FIGS. 1A-C. Each refuge room 200 can be configured to providing living quarters for a selected individual occupant (not shown) and optionally for temporarily accommodating one or more visitors. In selected embodiments, the selected individual occupant can comprise an individual, including man and/or a woman, who is reentering a community after release from prison, jail or other form of incarceration.

As shown in FIGS. 8A-B, a selected refuge room 200 can comprise one or more folding panels, walls or other physical side barrier members 210 that can enclose or otherwise define an internal refuge room space 220 within the refuge room 200. In other words, the side barrier members 210 that can define a perimeter around the internal refuge room space 220 of the refuge room 200. The side barrier members 210 can be provided in the manner described above with reference to the side barrier members 210 of FIGS. 1A-C. In selected embodiments, at least one of the side barrier members 210 can include one or more stackable side barrier members components.

As illustrated in FIGS. 8A-B, for example, the refuge room 200 can comprise a first side barrier member 210A, a second side barrier member 210B, a third side barrier member 210C and a fourth side barrier member 210D. Each of the side barrier members 210A-D can include end regions 212.

Adjacent side barrier members 210 can be coupled to form the refuge room 200. As shown in FIGS. 8A-B, for example, end regions 212 of adjacent side barrier members 210 can be coupled as described herein with reference to the side barrier members 210 of FIGS. 1A-C. In selected embodiments, one or more of the side barrier members 210 can define at least one opening 215, such as a refuge room portal opening 215A and/or a refuge room window 215B. Each opening 215 advantageously can communicate with the internal refuge room space 220 of the refuge room 200. One or more of the openings 215 can comprise an unfilled void in the relevant side barrier member 210, and/or at least one selected opening 215, such as the refuge room window 215B, can be filled with a shatterproof transparent and/or translucent material (not shown), such as acrylic, Plexiglas or other suitable materials.

The transparent and/or translucent material can be fixed in the selected opening 215 and/or can be openable or otherwise adjustable to permit air to circulate within the refuge room 200 via the selected opening 215. Additionally and/or alternatively, a position of the refuge room door 230 can be adjustable relative to the refuge room portal opening 215A to provide, for example, additional air circulation within the refuge room 200 and/or a view outside of the refuge room 200. The openings 215 advantageously can be utilized to provide illumination within the internal refuge room space 220 of the refuge room 200 and/or to permit the individual occupant within the internal refuge room space 220 with a view outside of the refuge room 200. As desired, at least one of the openings 215 can be associated with a curtain or other window covering (not shown).

The refuge room 200 can include an optional refuge room door 230. In selected embodiments, the refuge room door 230 can be provided in the manner set forth above with reference to the refuge room door 230 of FIGS. 1A-C. The refuge room door 230, for example, can be disposed adjacent to the refuge room portal opening 215A. The refuge room door 230 can be rotatable, translatable or otherwise movable relative to the relevant side barrier member(s) 210. In other words, the refuge room door 230 can be adjustably coupled with the relevant side barrier member(s) 210. A position of the refuge room door 230 thereby can be adjustable relative to the refuge room portal opening 215A in the manner described above with reference to the refuge room door 230 of FIGS. 1A-C. The refuge room door 230, for example, can be adjustable to provide additional air circulation within the refuge room 200 and/or a view outside of the refuge room 200. The refuge room door 230 optionally can include a lock (not shown) for securing the refuge room door 230 in the closed position to restrict access to the internal refuge room space 220 and/or can be adjustably coupled with the first side barrier member 210A via a door track apparatus 218.

Although shown and described with reference to FIGS. 8A-B as including a single refuge room portal opening 215A, the refuge room can include any predetermined number of refuge room portal openings 215A. If the refuge room 200 includes more than one refuge room portal opening 215A, some or all of the refuge room portal openings 215A can be associated with a respective refuge room door 230 provided in the manner described herein.

Figure 9A:
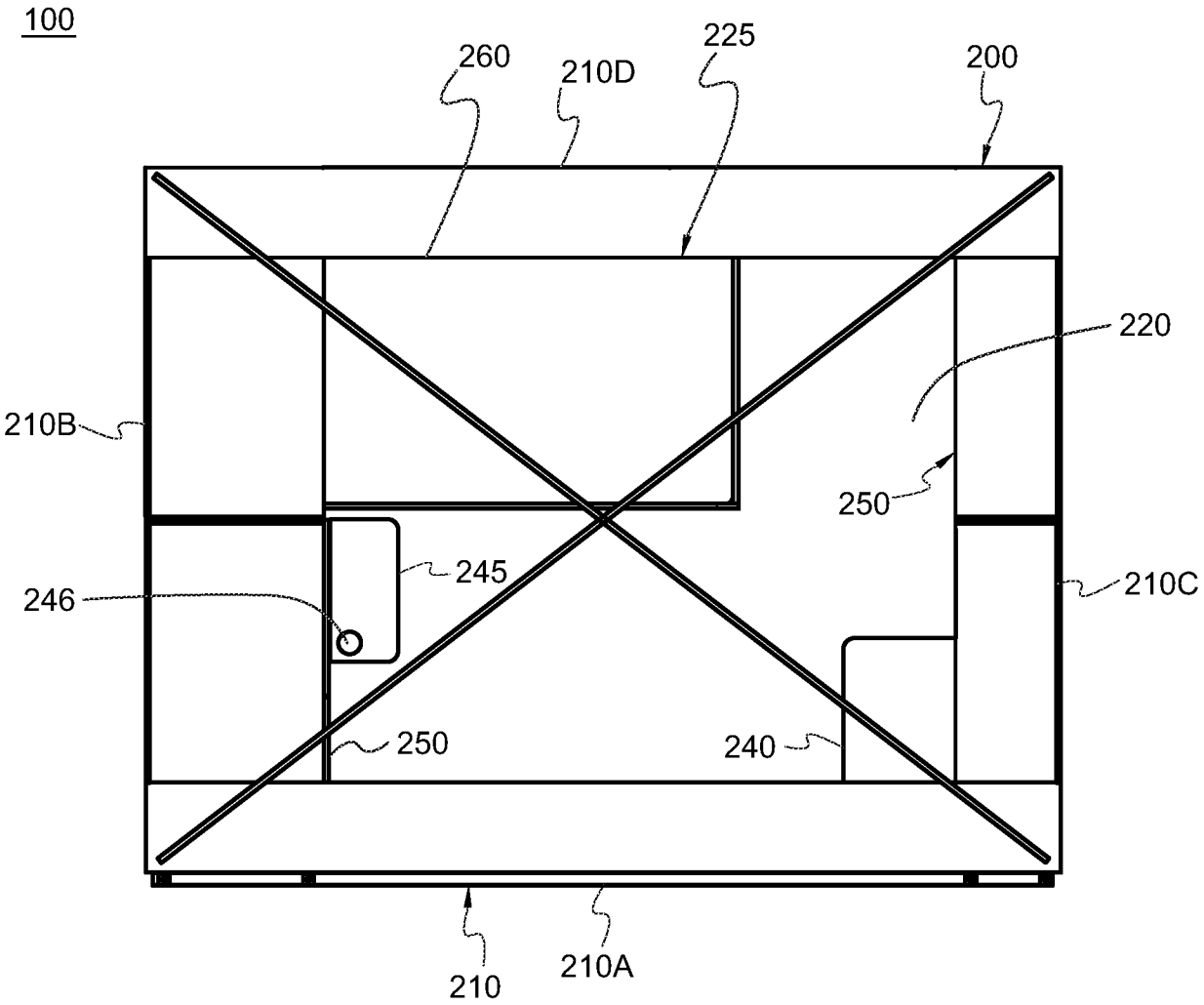
FIGS. 9A-C are detail diagrams illustrating an exemplary embodiment of an internal refuge room space of the refuge room of FIGS. 8A-C, wherein the internal refuge room space includes one or more furniture components.
Figure 9B:
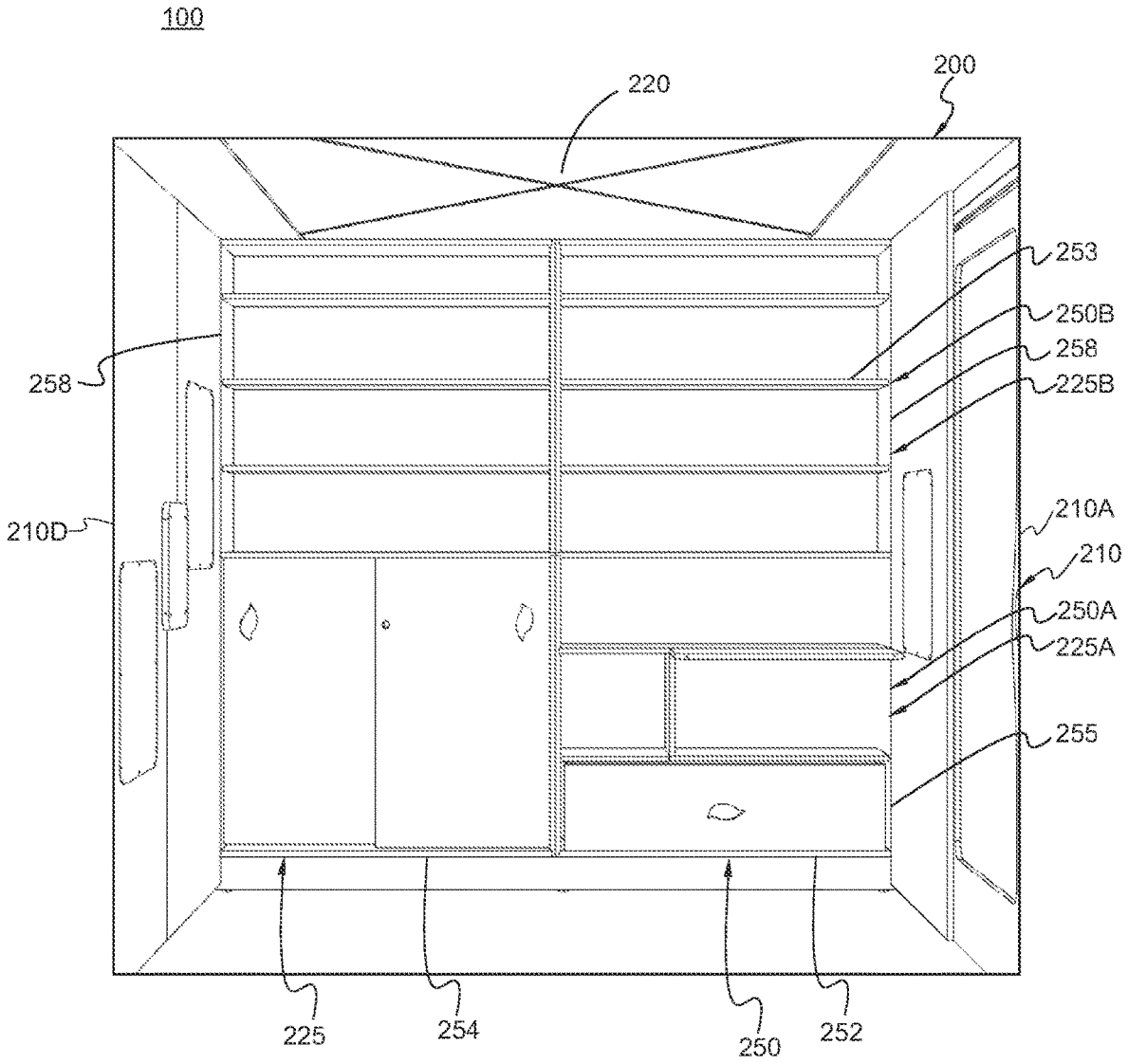
Figure 9C:
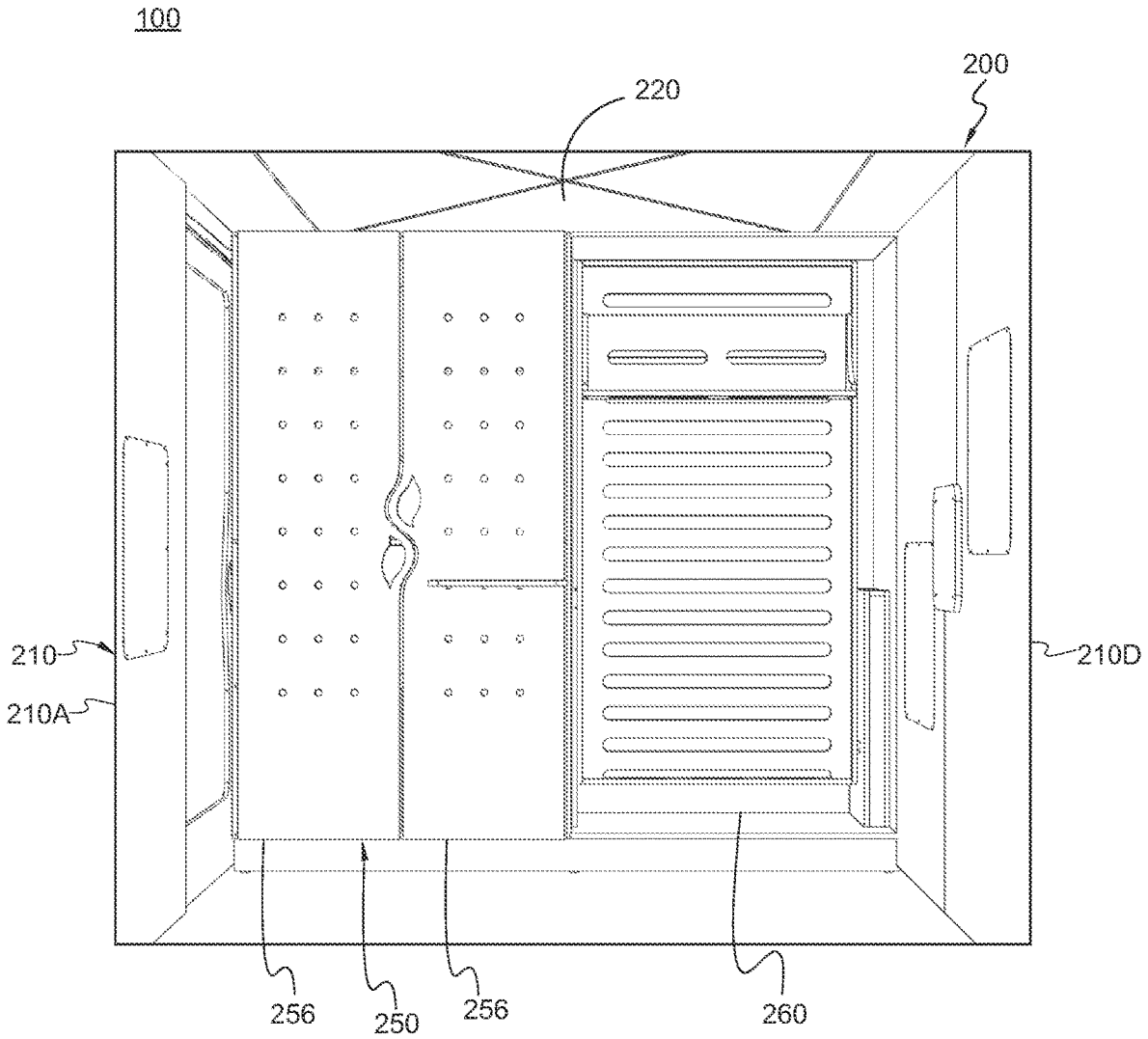

The refuge room 200 advantageously can include one or more furniture components 225 as illustrated in FIGS. 9A-C. The furniture components 225 can be disposed within the internal refuge room space 220 defined by the refuge room 200. In selected embodiments, one or more of the furniture components 225 can be integrated with a selected side barrier member 210. At least one other furniture component 225 optionally can be separate from the side barrier members 210. As shown in FIG. 9A, exemplary furniture components 225 can include, but are not limited to, at least one desk 240, one or more storage components 250, and/or a bed 260 and can be provided in the manner of the furniture components 225 described herein with reference to FIGS. 2A-C.

In selected embodiments, at least one selected furniture component 225 can comprise stackable furniture components. Stated somewhat differently, the selected furniture component 225 can comprise a lower furniture component 225A and an upper furniture component 225B configured to be disposed on the furniture component 225A. The lower furniture component 225A can comprise a lower furniture component type, such as the desk 240, the storage component 250 and/or the bed 260, that is the same as, or different from, an upper furniture component type of the upper furniture component 225B. If the lower furniture component 225A comprises a bookcase 252, for example, the upper furniture component 225B also can comprise another bookcase 252 and/or a shelving system 258. The lower furniture component 225A and the upper furniture component 225B preferably have substantially equal widths and/or optionally can be coupled in any conventional manner such as, for example, via one or more nails, screws or other fasteners.

The desk 240 of FIG. 9A can comprise any flat accessible, usable surface. The desk 240 can be at least partially integrated (or built into) a relevant side barrier member 210 and/or can be separate from the side barrier members 210 in the manner set forth above. In selected embodiments, the desk 240 can be coupled with the relevant side barrier member 210 via a hinge assembly (not shown) and folded down when not in use. The desk 240 alternatively can be removably coupled with the side barrier member 210 so that the desk 240 can be removed and stowed when not in use. The desk 240, for example, can be stowed in a selected storage component 250 when not in use. Additionally and/or alternatively, the desk 240 can be retractable within the side barrier member 210 so that the desk 240 can be retracted into the side barrier member 210 when not in use.

The storage components 250 can provide storage for clothing, valuables and other personal items of the individual occupant. Each storage component 250 can be disposed adjacent to a selected side barrier member 210. In selected embodiments, the storage components 250 can be at least partially integrated (or built into) a relevant side barrier member 210 and, very preferably can comprise the side barrier member 210. More than one side barrier member 210 can be associated with the storage components 250 and/or more than one storage component 250 can be associated with a selected side barrier member 210 as shown in FIGS. 9A-C.

In selected embodiments, the refuge room 200 can include a cup holder 245 with a flat accessible, usable surface that defines a cup holder opening 246 for receiving and holding a beverage container. The cup holder 245 advantageously can be coupled with another furniture component 225. As shown in FIG. 9A, for example, the cup holder 245 can be coupled with a selected storage component 250, such as a closet door of a closet 256 (shown in FIG. 9C). If disposed adjacent to the bed 260, the cup holder 245 advantageously can provide a nightstand for use by a refuge room occupant while utilizing the bed 260. The cup holder 245 can be adjustable coupled with the closet door so that the cup holder 245 can be stowed when not in use. For example, the cup holder 245 can be folding down when not in use.

Turning to FIG. 9B, for example, the storage components 250 can include at least one bookcase 252 with at least one optional drawer 255 and/or at least one cabinet 254 with one or more closing doors, without limitation. In selected embodiments, one or more of the shelves 253 of the bookcase 252 can be movable, enabling the shelves 253 to be moved out of the way when not in use.

Additionally and/or alternatively, one or more selected storage components 250 can comprise stackable the storage components. In other words, the selected storage components 250 can comprise a lower storage component 250A and an upper storage component 250B configured to be disposed on the storage component 250A. The lower storage component 250A can comprise a lower storage component type, such as the bookcase 252, the cabinet 254, the closet 256 and/or the shelving system 258, that is the same as, or different from, an upper storage component type of the upper storage component 250B. If the lower storage component 250A comprises a bookcase 252, for example, the upper storage component 250B also can comprise another bookcase 252 and/or a shelving system 258. As illustrated in FIG. 9B, the storage components 250 can include a shelving system 258 that can be disposed on a selected bookcase 252 and/or cabinet 254. The lower storage component 250A and the upper storage component 250B preferably have substantially equal widths and/or optionally can be coupled in any conventional manner such as, for example, via one or more nails, screws or other fasteners. FIG. 9C illustrates that the storage components 250 can include at least one closet 256.

One or more of the cabinets 254 and/or one or more of the closets 256 can include a lockable door. The cabinets 254 and/or closets 256 thereby can provide secure, locking storage for any valuables or other property of the individual occupant. In selected embodiments, a single storage component 250 can span a width of the selected side barrier member 210 and/or multiple storage components 250 can be positioned side-by-side along the width of the selected side barrier member 210 as illustrated in FIG. 9B.

As illustrated in FIG. 9C, the refuge room 200 can include one or more beds 260. Each bed 260 can be disposed proximately to, distally from, a selected side barrier member 210 and/or preferably can provided with a view of the portal 215 and/or the door 230. The bed 260, for example, can be at least partially integrated (or built into) a relevant side barrier member 210. Stated somewhat differently, the bed 260 can span a width of the selected side barrier member 210 and/or the bed 260 and at least one storage component 250 can be positioned side-by-side along the width of the selected side barrier member 210 as illustrated in FIG. 9C. In selected embodiments, the bed 260, either alone or in combination with one or more storage component 250, can comprise the side barrier member 210.

Additionally and/or alternatively, the bed 260 can be provided as a wall bed, a pull-down bed, a fold-down bed or any other kind of retractable bed to avoid consuming significant internal space 220 when not in use. The bed 260, for example, can be hinged at one end region for vertical storage against the selected side barrier member 210. In selected embodiments, the bed 260 advantageously can be configured for storage inside a closet or cabinet, such as the cabinet 256. Although shown and described with reference to FIGS. 9A-C as including the desk 240, the storage components 250 and the bed 260 for purposes of illustration only, the refuge room 200 can include any predetermined number, combination and type of the furniture components, as desired.

The furniture components 225 of the refuge room 200 advantageously can be customized for any specific need or use of an intended individual occupant. In selected embodiments, installed furniture components 225 of the refuge room 200 can be readily exchanged or otherwise replaced, for example, if damaged, if a current occupant of the refuge room 200 has new needs and/or if a new occupant is moving into the refuge room 200. The refuge room 200, in other words, can be adapted to meet one or more personal preferences of an intended occupant of the refuge room 200. The refuge rooms 200 thereby can enable the intended occupant to customize the refuge rooms 200 to meet any personal preferences.

The refuge room 200, for example, can include a foldable desk 240, at least one foldable chair and/or other furniture (not shown), a compartment (not shown) for trash, a compartment (not shown) for dirty clothes, a compartment (not shown) for hanging clothes, electrical power, heating and/or cooling system (not shown), one or more fixed, portable and/or controllable lighting fixtures (not shown), Wireless Fidelity (Wi-Fi) or other internet access and/or a room location (not shown) for displaying photographs, pictures or other artwork, without limitation. In selected embodiments, a selected furniture component can serve multiple functions. The selected furniture component, for example, can provide a seating function and/or a storage function.

In selected embodiments, each refuge room 200 can include one or more electrical outlets and/or one or more data ports, such as a Universal Serial Bus (or USB) port.

Preferably comprising basic living units with access to common sinks, lavatories, showers and other facilities within an operating environment 120 (shown in FIG. 7) of the refuge room 200, the refuge rooms 200 optionally can include at least one plumbing, water and/or sewage hook-up.

In the manner set forth above with reference to FIGS. 9A-C, one or more of the side barrier members 210 of the refuge room 200 can comprise at least one of the furniture components 225. Stated somewhat differently, at least one of the side barrier members 210 can be formed from one or more furniture components 225. Selected furniture components 225, in selected embodiments, can be coupled to form the side barrier member 210 as a continuous side barrier member. In other words, the side barrier member 210 includes no gaps between adjacent furniture components 225 to help ensure privacy for the refuge room occupant. The furniture components 225 can be coupled in any conventional manner such as, for example, via one or more nails, screws or other fasteners.

Figure 10C:
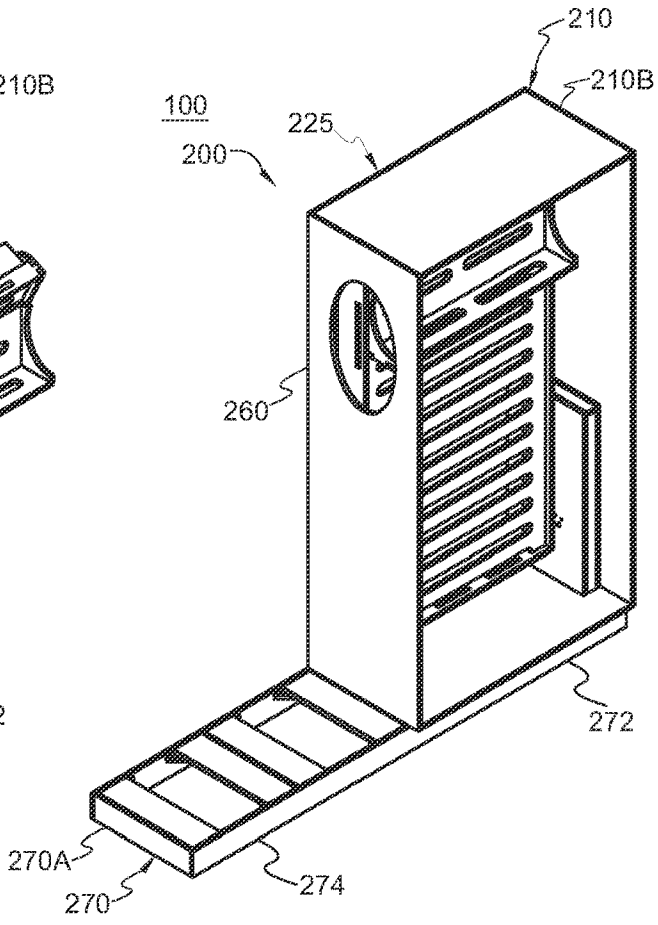
FIGS. 10A-F are detail diagrams illustrating an exemplary embodiment of the refuge room of FIGS. 9A-C, wherein a first selected side barrier member of the refuge room comprises at least one of the furniture components.
Figure 10B:
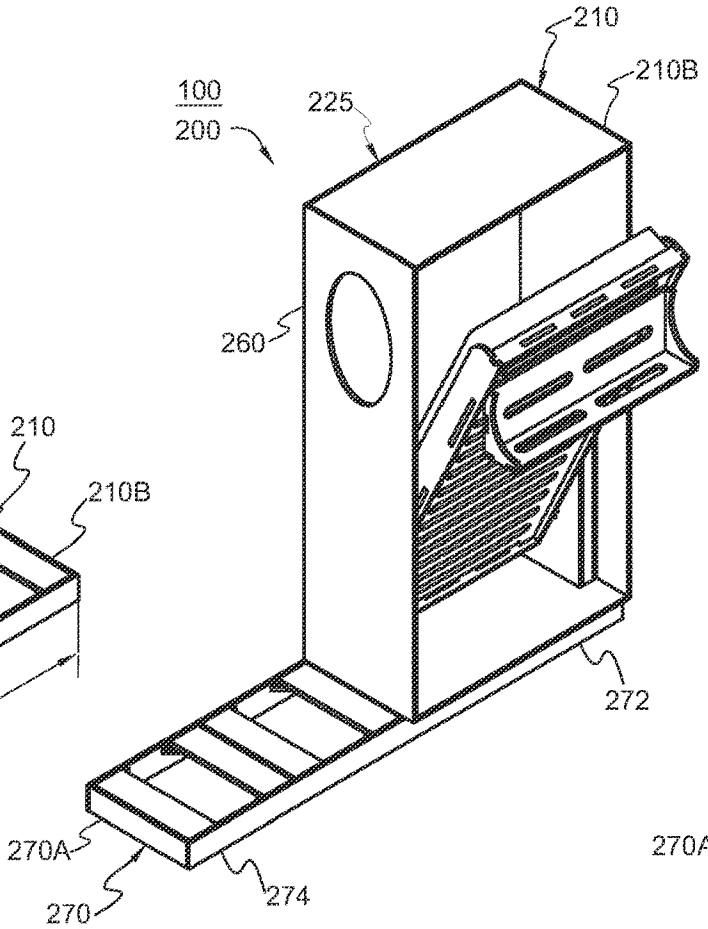
Figure 10A:
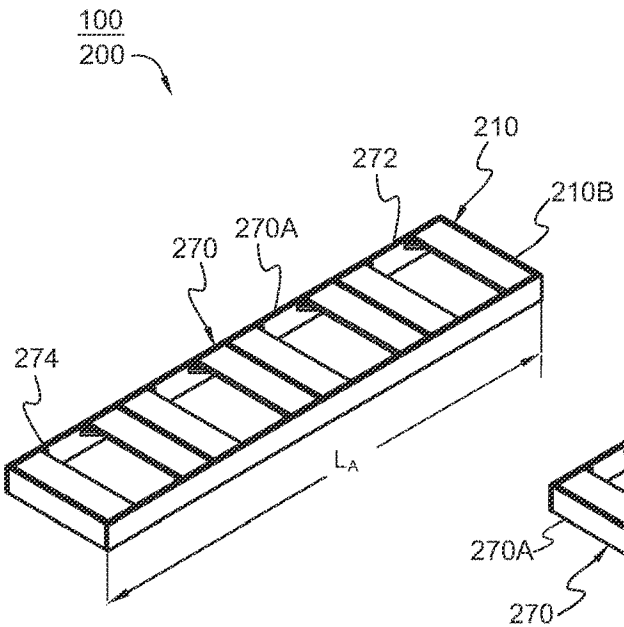

The second side barrier member 210B, for example, can comprise the bed 260, either alone or in combination with one or more other furniture components 225, as shown in FIGS. 10A-F. In selected embodiments, the bed 260 and any other furniture components 225 can be disposed upon, and supported by, a side barrier base member 270. Turning to FIG. 10A, the second side barrier member 210B can include a first side barrier base member 270A. The first side barrier base member 270A can have first and second end regions 272, 274 and a first predetermined length LA. The first side barrier base member 270A can provide a foundation for the second side barrier member 210B and support the bed 260 and/or the other furniture components 225. Stated somewhat differently, the first side barrier base member 270A can comprise an interface between the bed 260 and/or the other furniture components 225 and a floor (not shown) of an operating environment 120 (shown in FIG. 7) of the refuge room 200.

The bed 260 can be disposed on a selected portion of the first side barrier base member 270A as illustrated in FIGS. 10B-C. Turning to FIG. 10B, the selected portion, for example, can comprise the proximal end region 272 of the first side barrier base member 270A. The bed 260 can span the entire first side barrier base member 270A or, as shown in FIG. 10B, can partially span the first side barrier base member 270A. The bed 260 can be coupled with the first side barrier base member 270A via one or more fasteners or any other conventional manner.

Figures 10D, 10E, 10F:
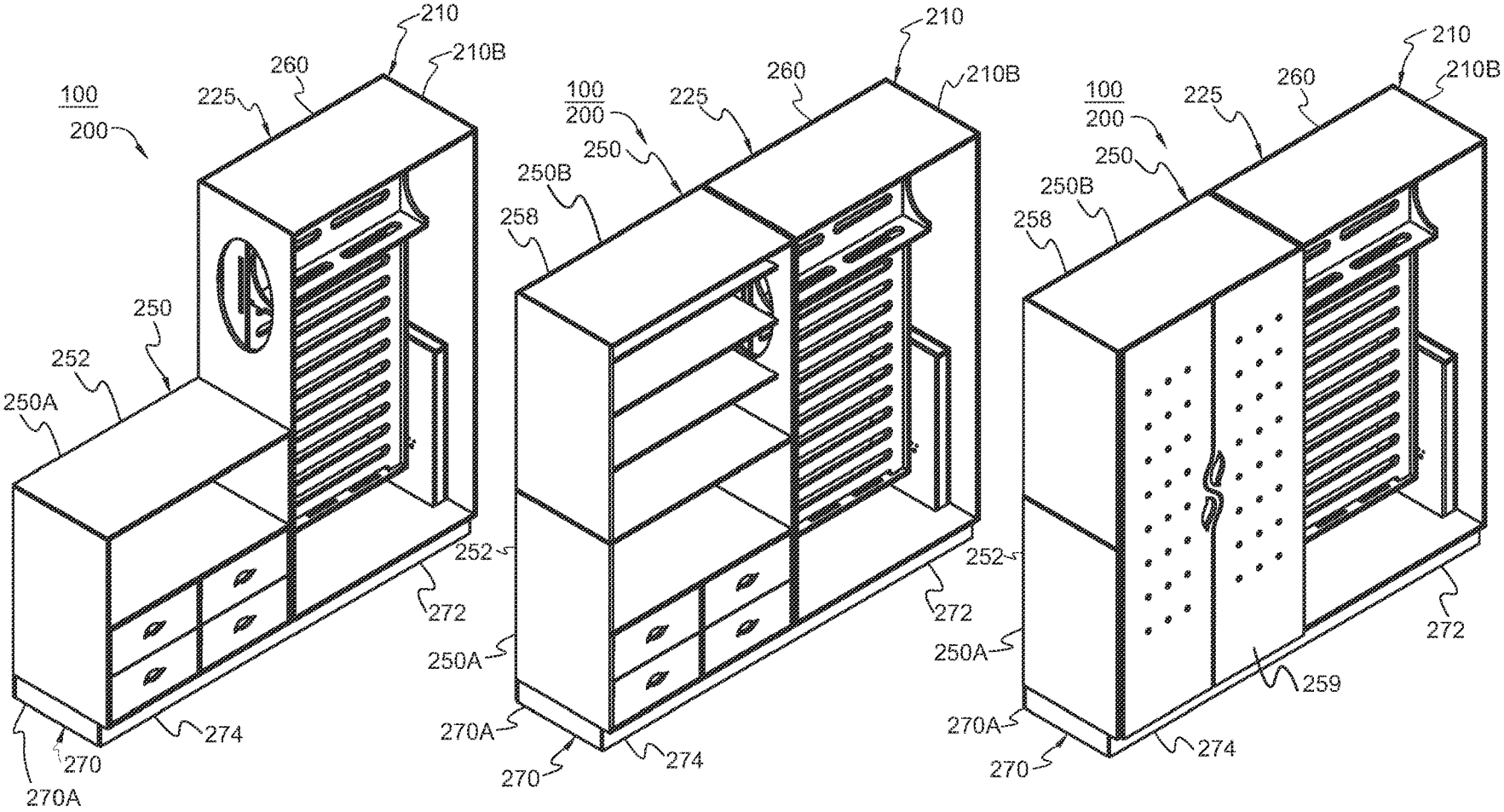

If the bed 260 partially spans the first side barrier base member 270A, one or more other furniture components 225 can be disposed on the first side barrier base member 270A. Turning to FIG. 10D, for example, a bookcase 252 can be disposed on the first side barrier base member 270A. The bookcase 252 can be disposed adjacent to the bed 260 on the first side barrier base member 270A as shown in FIG. 10D. In selected embodiments, the bookcase 252 can be disposed between the proximal end region 272 and the distal end region 274 and/or, as shown in FIG. 10D, at the distal end region 274 of the first side barrier base member 270A.

The bookcase 252 preferably abuts the bed 260 when disposed on the first side barrier base member 270A to form the second side barrier member 210B as a continuous side barrier member 210. In other words, the second side barrier member 210B includes no gaps between any adjacent furniture components 225 to help ensure privacy for the refuge room occupant. Additionally and/or alternatively, the bookcase 252 can be coupled with the first side barrier base member 270A and/or the bed 260, for example, via one or more fasteners, such nails or screws, or any other conventional manner.

Additionally and/or alternatively, one or more additional furniture components 225 can be disposed upon the first side barrier base member 270A such that the furniture components 225 span the first side barrier base member 270A or otherwise complete the second side barrier member 210B. If a height of the bookcase 252 is less than a height of the bed 260, at least one upper storage component 250B can be disposed on the bookcase 252 to compensate for the height difference. The upper storage component 250B preferably abuts the bookcase 252 and/or the bed 260. Stated somewhat differently, no gaps are included between the upper storage component 250B, the bookcase 252 and/or the bed 260 to help ensure privacy for the refuge room occupant.

A shelving system 258, for example, can be disposed on the bookcase 252 as shown in FIGS. 10E-F. In selected embodiments, the bookcase 252 can be disposed between the shelving system 258 and the first side barrier base member 270A in the manner illustrated in FIGS. 10E-F. One or more doors 259 optionally can be coupled with the bookcase 252 and/or the shelving system 258. The doors 259 can alternate between a closed position as shown in FIG. 10F for enclosing an interior portion of the bookcase 252 and/or the shelving system 258 and an open position for permitting access to the interior portion of the bookcase 252 and/or the shelving system 258.

The shelving system 258 preferably abuts the bookcase 252 and/or the bed 260 when disposed on the bookcase 252 to form the second side barrier member 210B as a continuous side barrier member 210. In other words, the second side barrier member 210B includes no gaps between any adjacent furniture components 225 to help ensure privacy for the refuge room occupant. The bed 260, bookcase 252 and the shelving system 258 are shown as spanning the proximal end region 272 and the distal end region 274 of the first side barrier base member 270A, completing the second side barrier member 210B. Additionally and/or alternatively, the shelving system 258 can be coupled with the bookcase 252 and/or the bed 260, for example, via one or more fasteners, such nails or screws, or any other conventional manner.

The furniture components 225 that comprise a selected side barrier member 210 of the refuge room 200 can be uniform and/or different. Additionally and/or alternatively, the furniture components 225 included in the second side barrier member 210B can be the same as, or different from, the furniture components 225 included in the third side barrier member 210C.

Turning to FIGS. 11A-F, the third side barrier member 210C can comprise one or more storage components 250 or other furniture components 225. The third side barrier member 210C can include a second side barrier base member 270B. The second side barrier base member 270B can have first and second end regions 272, 274 and a second predetermined length $L_B$. Although preferably equal to the first side barrier base member 270A (collectively shown in FIG. 10A), the second predetermined length $L_B$ optionally can be greater than or less than the first predetermined length $L_A$ of the first side barrier base member 270A. Advantageously, the second side barrier base member 270B can provide a foundation for the third side barrier member 210C and support the storage components 250 and/or the other furniture components 225. Stated somewhat differently, the second side barrier base member 270B can comprise an interface between the storage components 250 and/or the other furniture components 225 and the floor (not shown) of the operating environment 120 (shown in FIG. 7).

Figure 11C:
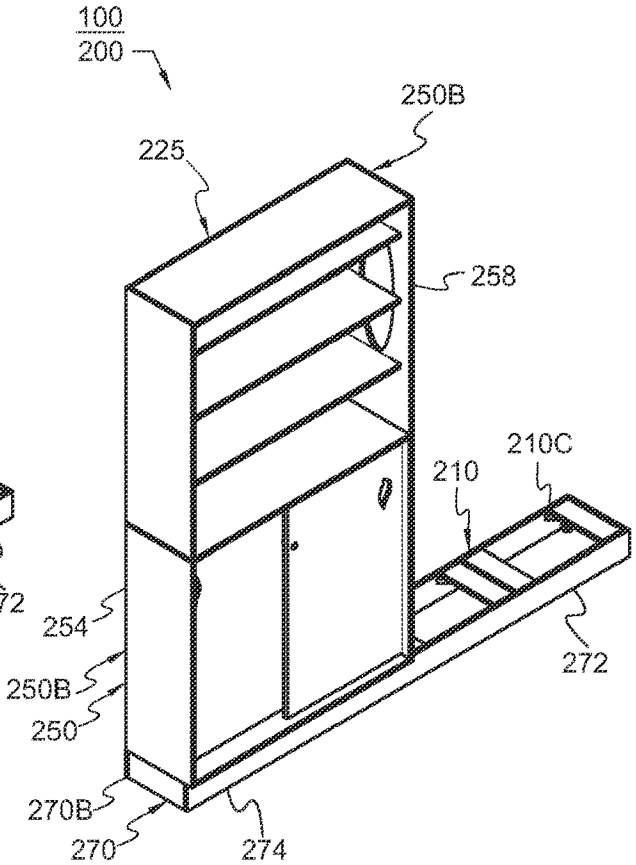
FIGS. 11A-F are detail diagrams illustrating an alternative exemplary embodiment of the refuge room of FIGS. 9A-C, wherein a second selected side barrier member of the refuge room comprises at least one of the furniture components.
Figure 11B:
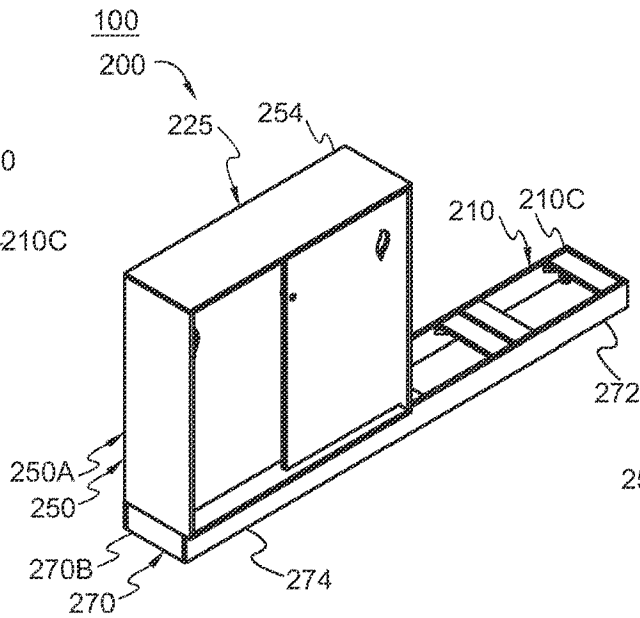
Figure 11A:
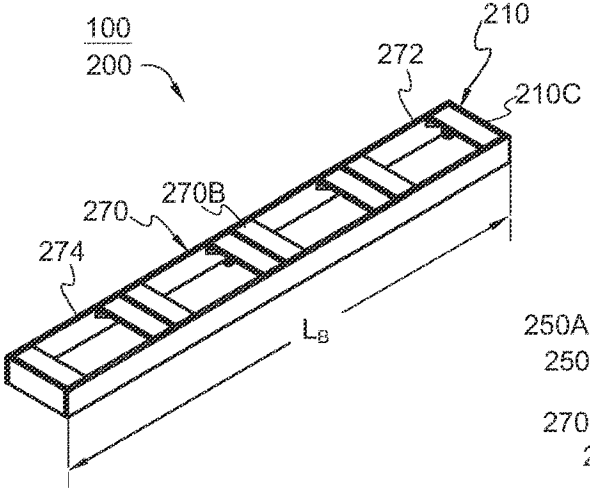

Turning to FIG. 11B, the storage components 250 associated with the third side barrier member 210C can include a cabinet 254. The cabinet 254 can be disposed on a selected portion of the second side barrier base member 270B. The selected portion, for example, can comprise a distal end region 274 of the second side barrier base member 270B as shown in FIG. 11B. The cabinet 254 can span the entire second side barrier base member 270B or, as illustrated in FIG. 11B, can partially span the second side barrier base member 270B. The cabinet 254 can be coupled with the second side barrier base member 270B via one or more fasteners or any other conventional manner.

As desired, one or more additional furniture components 225 can be disposed upon the second side barrier base member 270B such that the furniture components 225 span the second side barrier base member 270B or otherwise complete the third side barrier member 210C. If a height of the cabinet 254 is less than the height of the bed 260 (shown in FIGS. 10A-F) or another selected furniture component 225, for example, at least one upper storage component 250B can be disposed on the cabinet 254 to compensate for the height difference. The upper storage component 250B preferably abuts the cabinet 254. Stated somewhat differently, no gaps are included between the upper storage component 250B and the cabinet 254 to help ensure privacy for the refuge room occupant. A first shelving system 258 can be disposed on the cabinet 254 as shown in FIG. 11C. In selected embodiments, the cabinet 254 can be disposed between the first shelving system 258 and the second side barrier base member 270B.

Figures 11D, 11E, 11F:
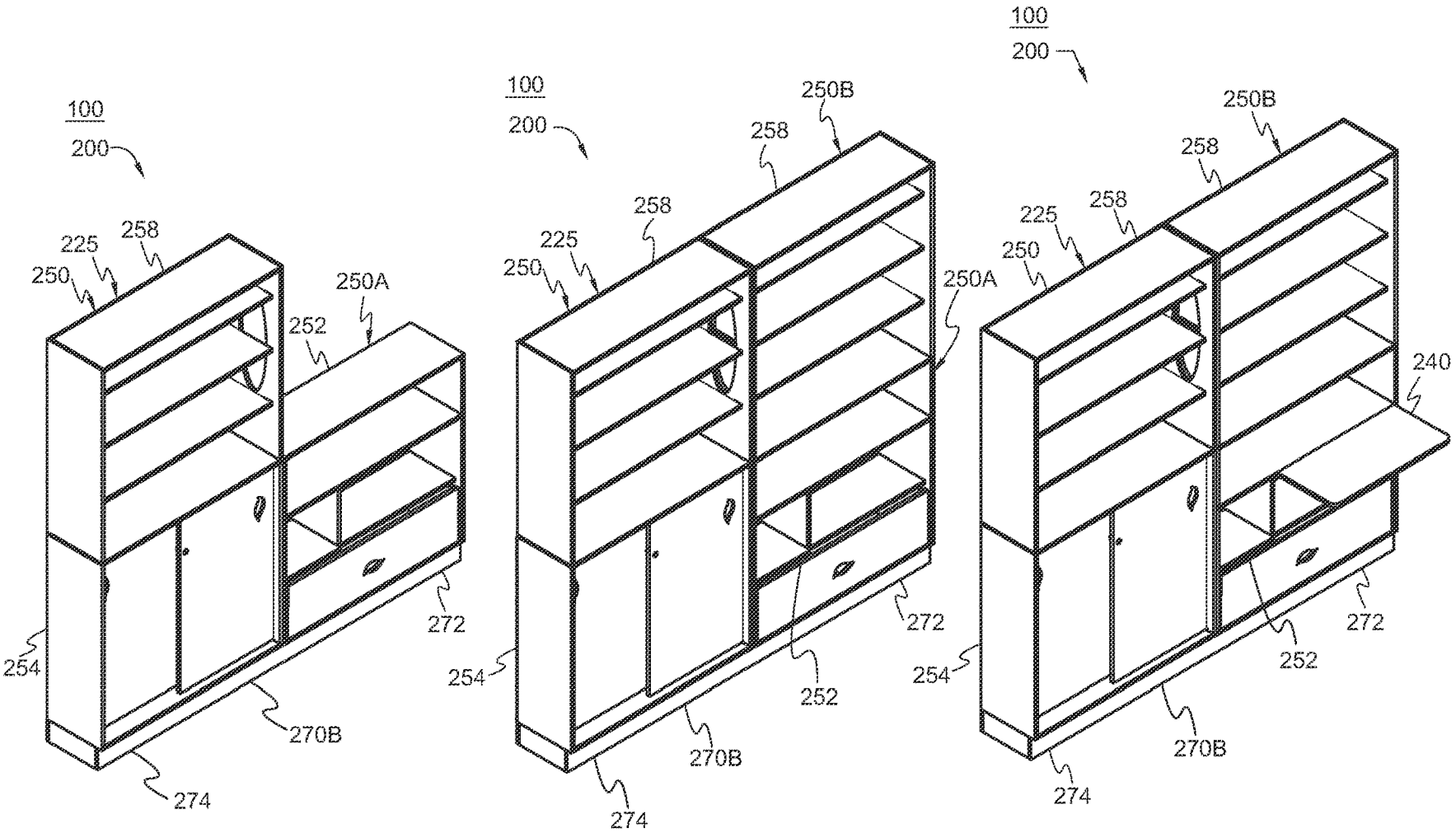

If the cabinet 254 and/or the first shelving system 258 partially spans the second side barrier base member 270B, one or more other furniture components 225 can be disposed on the second side barrier base member 270B in the manner discussed in more detail above with reference to FIGS. 4A-F. As shown in FIG. 11D, a bookcase 252 can be disposed on the second side barrier base member 270B. The bookcase 252 can be disposed adjacent to the cabinet 254 on the second side barrier base member 270B as illustrated in FIG. 11D. In selected embodiments, the bookcase 252 can be disposed between the proximal end region 272 and the distal end region 274 and/or at a proximal end region 272 of the second side barrier base member 270B as shown in FIG. 11D One or more additional furniture components 225 can be disposed upon the second side barrier base member 270B such that the furniture components 225 span the second side barrier base member 270B or otherwise complete the third side barrier member 210C. If a height of bookcase 252 is less than a combined height of the cabinet 254 and the first shelving system 258, for example, at least one upper storage component 250B can be disposed on the bookcase 252 to compensate for the height difference. The upper storage component 250B preferably abuts the bookcase 252, the cabinet 254 and/or the first shelving system 258. Stated somewhat differently, no gaps are included between the upper storage component 250B and the bookcase 252, the cabinet 254 and/or the first shelving system 258 to help ensure privacy for the refuge room occupant. A second shelving system 258 can be disposed on the bookcase 252 as shown in FIG. 11E. In selected embodiments, the bookcase 252 can be disposed between the second shelving system 258 and the second side barrier base member 270B.

An optional desk 240 can extend from the bookcase 252 as illustrated in FIG. 11F. Stated somewhat differently, the desk 240 can be at least partially integrated (or built into), and/or separate from, the bookcase 252 in the manner set forth above. The desk 240 can comprise any flat accessible, usable surface. In selected embodiments, the desk 240 can be at least partially retractable into the bookcase 252 as shown in FIG. 11E so that the desk 240 can be stowed when not in use.

The bookcase 252 and/or the second shelving system 258 preferably abut the cabinet 254 and/or the first shelving system 258 when disposed on the second side barrier base member 270B to form the third side barrier member 210C as a continuous side barrier member 210. In other words, the third side barrier member 210C includes no gaps between any adjacent furniture components 225 to help ensure privacy for the refuge room occupant. The bookcase 252, the cabinet 254 and the first and second shelving systems 258 are shown as spanning the proximal end region 272 and the distal end region 274 of the second side barrier base member 270B, completing the third side barrier member 210C. Additionally and/or alternatively, the bookcase 252, the cabinet 254, the first shelving system 258 and/or the second shelving systems 258 can be coupled, for example, via one or more fasteners, such nails or screws, or any other conventional manner.

In selected embodiments, the furniture components 225 can be constructed with respective predetermined widths based upon the predetermined length, such as the first predetermined length $L_A$ or the second predetermined length $L_B$, of the side barrier base member 270. The furniture components 225 of the refuge room 200, in other words, can be provided in a modular manner such that installed furniture components 225 can be readily exchanged or otherwise replaced, for example, if damaged, if a current occupant of the refuge room 200 has new needs and/or if a new occupant is moving into the refuge room 200. A damaged cabinet 254, for example, can be replaced with a new cabinet 254. Additionally and/or alternatively, an installed cabinet 254 can be replaced with a bookcase 252, for instance, if the occupant possesses a large number of books.

Figure 12:
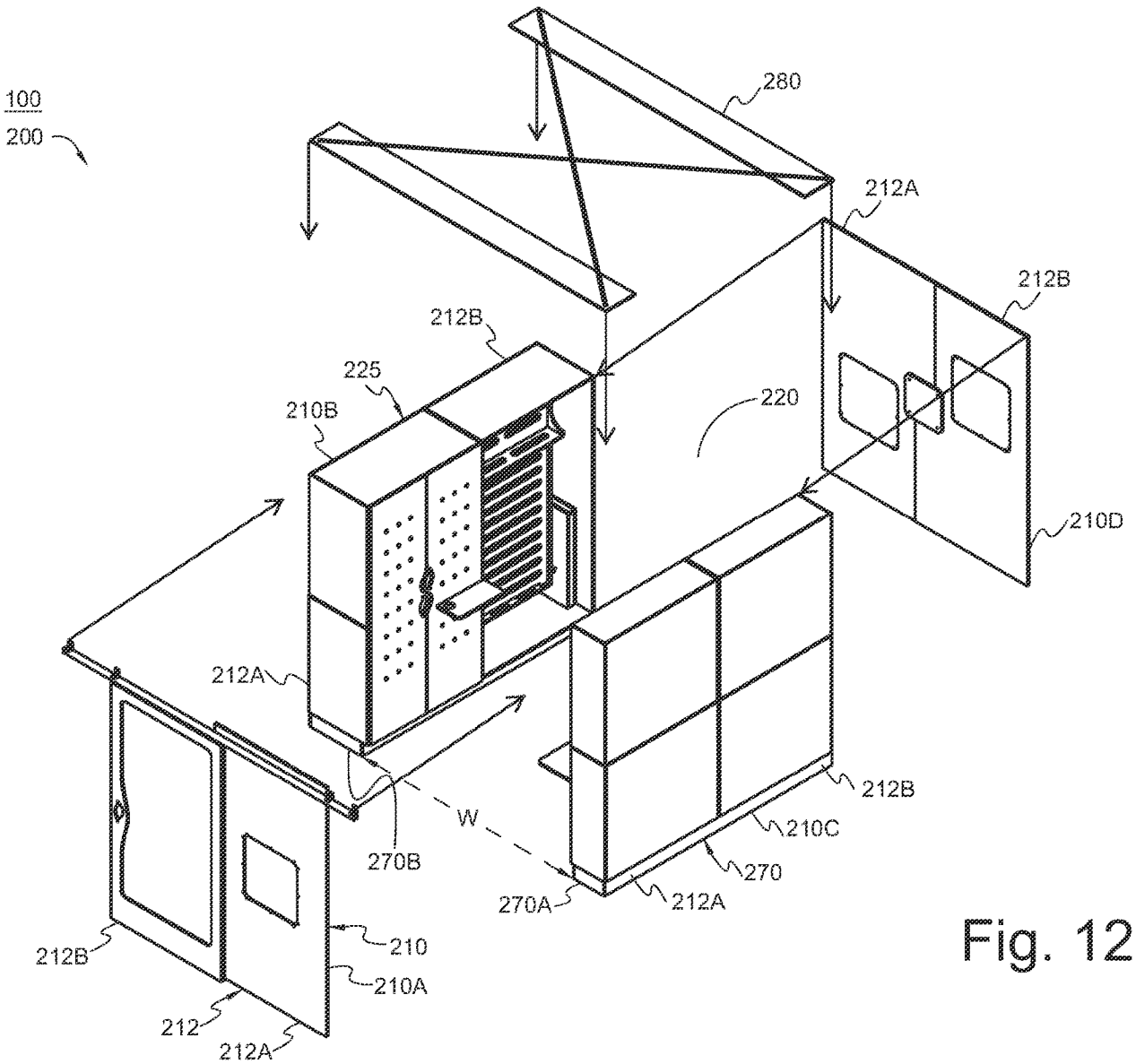
FIG. 12 is a detail diagram illustrating another alternative exemplary embodiment of the refuge room of FIGS. 9A-C, wherein the first selected side barrier member of FIGS. 10A-F and the second selected side barrier member of FIGS. 11A-F are coupled to form the refuge room.

In the manner discussed in more detail above with reference to the refuge room 200 of FIGS. 8A-B, the side barrier members 210 can be coupled to form the refuge room 200. The second side barrier member 210B of FIGS. 10A-F and the third side barrier member 210C of FIGS. 11A-F, for example, can be coupled via first and fourth side barrier members 210A, 210D as illustrated in FIG. 12. In selected embodiments, the first side barrier base member 270A of the second side barrier member 210B can be disposed at a first predetermined location of a floor (not shown) of the operating environment 120 (shown in FIG. 7). One or more one or more furniture components 225 can be assembled on the first side barrier base member 270A to form the second side barrier member 210B in the manner discussed in more detail above with reference to the second side barrier member 210B of FIGS. 10A-F.

The second side barrier base member 270B of the third side barrier member 210C can be disposed at a second predetermined location of the floor of the operating environment 120. As shown in FIG. 12, the second predetermined location of the second side barrier base member 270B can be a preselected distance W from the first side barrier base member 270A of the second side barrier member 210B. The first side barrier base member 270A and the second side barrier base member 270B can be disposed in any suitable configuration, including a parallel configuration in which the first side barrier base member 270A is substantially parallel to the second side barrier base member 270B. The first side barrier base member 270A optionally can be disposed at a predetermined angle relative to the second side barrier base member 270B.

One or more furniture components 225 can be assembled on the second side barrier base member 270B to form the third side barrier member 210C. Although shown and described as being formed by assembling furniture components 225 on spaced-apart side barrier base members 270 for purposes of illustration only, the second side barrier member 210B and/or the third side barrier member 210C can be assembled before being disposed on the floor of the operating environment 120.

Once the second side barrier member 210B and the third side barrier member 210C have been disposed at the respective first and second predetermined locations, the first side barrier member 210A can be disposed adjacent to the second side barrier member 210B and the third side barrier member 210C. As shown in FIG. 12, the first end region 212A of the first side barrier member 210A can be disposed adjacent to the first end region 212A of the second side barrier member 210B, whereas, the second end region 212B of the first side barrier member 210A can be disposed adjacent to the first end region 212A of the third side barrier member 210C. The first end region 212A of the first side barrier member 210A and the first end region 212A of the second side barrier member 210B can be coupled, and the second end region 212B of the first side barrier member 210A and the first end region 212A of the third side barrier member 210C can be coupled.

The fourth side barrier member 210D likewise can be disposed adjacent to the second side barrier member 210B and the third side barrier member 210C. The first end region 212A of the fourth side barrier member 210D can be disposed adjacent to the second end region 212B of the second side barrier member 210B, whereas, the second end region 212B of the fourth side barrier member 210D can be disposed adjacent to the second end region 212B of the third side barrier member 210C as illustrated in FIG. 12. Thereafter, the first end region 212A of the fourth side barrier member 210D and the second end region 212B of the second side barrier member 210B can be coupled, and the second end region 212B of the fourth side barrier member 210D and the second end region 212B of the third side barrier member 210C can be coupled.

The first side barrier member 210A, the second side barrier member 210B, the third side barrier member 210C and the fourth side barrier member 210D thereby can define a perimeter around the internal refuge room space 220 of the refuge room 200. To help ensure structural integrity of the refuge room 200, a metal strap cross brace 280 optionally can be placed across a top of the refuge room 200 and attached at the corners where adjacent side barrier members 210 meet. A pair of metal strap cross braces, for example, can diagonally span the refuge room 200 in an "X" formation as shown in FIG. 12.

In the manner set forth above, the side barrier members 210 can enclose or otherwise define the internal refuge room space 220 within the refuge room 200. The preselected distance W between the second side barrier member 210B and the third side barrier member 210C can help define a width of the internal refuge room space 220 within the refuge room 200. Additionally and/or alternative, a length of the internal refuge room space 220 within the refuge room 200 can be defined by the first predetermined length $L_A$ of the first side barrier base member 270A of the second side barrier member 210B and/or the second predetermined length $L_B$ of the second side barrier base member 270B of the third side barrier member 210C.

In selected embodiments, one or more refuge rooms 200 can be grouped for provide a refuge room cluster in the manner discussed in more detail above with reference to the refuge room cluster 202 of FIGS. 6A-B. The refuge rooms 200 and/or the refuge room clusters 202 can be disposed within an operating environment as set forth above with reference to the operating environment 120 shown in FIG. 7. The refuge rooms 200 can include single (or unclustered) refuge rooms 200 and/or one or more refuge room clusters 202. The refuge room clusters 202 can be uniform and/or different. Stated somewhat differently, each refuge room cluster 202 can have a predetermined number of refuge rooms 200 that are arranged in a predetermined configuration that can be the same as, or different from, the number and configuration refuge rooms associated with one or more other refuge room clusters 202.

The refuge room 200 preferably is provided as a mobile refuge room. Stated somewhat differently, the refuge room 200 can be readily disassembled at a first (or original) geographic location for shipment to a second (or destination) geographic location, such as an operating environment 120 (shown in FIG. 7), for reassembly. The folding side barrier members 210 and/or the optional door 230, for example, can be flat-packed for facilitating transport to the destination location and, upon arrival at the destination location, can be unfurled or otherwise assembled to create each refuge room 200.

When the refuge room 200 is assembled, a room base (not shown) can be deployed and leveled at the destination location. The room base preferably is secured to a floor (not shown) of the destination location. The door 230 likewise can be formed from boxes and other shipping containers (not shown) and can be disposed in a channel spanning across the portal 215 between the side barrier members 210. The boxes and other shipping containers optionally can comprise furniture components for the refuge room 200 and can be coupled with the room base. The boxes and other shipping containers can be connected at their sides via one or more fasteners. Additionally and/or alternatively, the boxes and other shipping containers used for transporting the folding side barrier members 210 and/or the optional door 230 can become at least one of the furniture components 225.

As used herein, a phrase in the form of at least one of A, B, C and D herein is to be construed as meaning one or more of A, one or more of B, one or more of C and/or one or more of D.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

What is claimed is:

1. A refuge room being configured for delivery to a predetermined internal operating environment in at least one shipping container, comprising:

a first side barrier base member being positioned atop a floor of the internal operating environment; and a plurality of side barrier members being arranged to define a perimeter around an uncovered internal refuge room space and including a first side barrier member being positioned atop the floor of the internal operating environment and defining a refuge room doorway in communication with the internal refuge room space and a second side barrier member being disposed on said first side barrier base member and comprising a bed, wherein a side panel of a selected shipping container is coupled with the first side barrier member and forms a refuge room door for the refuge room doorway, and wherein the internal refuge room space provides living quarters within the internal operating environment for an individual who is reentering a community after release from incarceration.

2. The refuge room of claim 1, wherein the bed comprises a vertically-retractable wall bed that engages the floor of the internal operating environment during use.

3. The refuge room of claim 1, wherein said second side barrier member further comprises a second furniture component being disposed on said first side barrier base member and adjacent to the bed, the bed and the second furniture component providing a continuous side barrier member.

4. The refuge room of claim 3, wherein the second furniture component includes a desk, a bookcase, a cabinet, a shelving system or a closet.

5. The refuge room of claim 3, further comprising a cup holder being coupled with the second furniture component and having a flat usable surface defining a cup holder opening for receiving and holding a beverage container, the cup holder providing a nightstand for use in conjunction with the bed.

6. The refuge room of claim 3, wherein a height of the second furniture component is less than a height of the bed, and wherein a third furniture component is disposed on the second furniture component and adjacent to the bed, the third furniture component with the bed and the second furniture component providing the continuous side barrier member, a combined height of the second and third furniture components being equal to the height of the bed.

7. The refuge room of claim 3, wherein said second side barrier member further comprises a third furniture component being disposed adjacent to the second furniture component, the third furniture component with the bed and the second furniture component providing the continuous side barrier member.

8. The refuge room of claim 7, wherein a fourth furniture component is disposed on the third furniture component and adjacent to the second furniture component, the fourth furniture component with the bed, the second furniture component and the third furniture component providing the continuous side barrier member, a combined height of the third and fourth furniture components being equal to the height of the bed.

9. The refuge room of claim 1, wherein the refuge room door is adjustably coupled with said first side barrier member and movable between a first position for permitting access to the internal refuge room space via the refuge room doorway and a second position for inhibiting access to the internal refuge room space via the refuge room doorway.

10. The refuge room of claim 9, wherein said first side barrier member comprises a first member section and a second member section being coupled by a door track apparatus for enabling the refuge room door to translate between the first and second positions, the refuge room doorway being defined between the first and second member sections.

11. The refuge room of claim 1, further comprising a second side barrier base member being positioned atop the floor of the internal operating environment, wherein the plurality of side barrier members further includes a third side barrier member being disposed on said second side barrier base member and comprising a second furniture component being disposed adjacent to a third furniture component and providing a continuous side barrier member.

12. The refuge room of claim 11, wherein the first side barrier member is disposed between the second side barrier member and the third side barrier member.

13. The refuge room of claim 1, wherein at least one of said side barrier members defines a window opening.

14. The refuge room of claim 3, wherein the second furniture component is formed from a second selected shipping container.

15. A cluster of refuge rooms, comprising:

the refuge room of claim 1; and a second refuge room comprising a second side barrier base member being positioned atop the floor of the internal operating environment and a second plurality of side barrier members being arranged to define a second perimeter around a second uncovered internal refuge room space and including a first side barrier member being positioned atop the floor of the internal operating environment and defining a second refuge room doorway in communication with the second internal refuge room space and a second side barrier member being disposed on said second side barrier base member and comprising a second bed, wherein the refuge room and the second refuge room abut to form a shared common side barrier member, and wherein the second internal refuge room space provides second living quarters within the internal operating environment for a second individual who is reentering the community after release from incarceration.

16. A method for constructing a refuge room being configured for delivery to a predetermined internal operating environment in at least one shipping container, comprising:

disposing first and second side barrier base members atop a floor of the operating environment, the first side barrier base member being disposed at a preselected distance from the second side barrier base member;

disposing a first furniture component adjacent to a vertically-retractable wall bed assembly on the first side barrier base member to form a first continuous side barrier member of a plurality of side barrier members being arranged to define an uncovered internal refuge room space;

disposing a second furniture component adjacent to a third furniture component on the second side barrier base member to form a second continuous side barrier member among the plurality of side barrier members, the second side barrier base member having a predetermined length that is equal to a length of the first side barrier base member;

coupling the first continuous side barrier member and the second continuous side barrier member via a third side barrier member being positioned atop the floor of the internal operating environment and defining a refuge room doorway in communication with the internal refuge room space; and coupling a side panel of a selected shipping container with the third side barrier member, the selected shipping container forming a refuge room door for the refuge room doorway, wherein the internal refuge room space has a refuge room width that is equal to the predetermined distance, has a refuge room depth that is equal to the predetermined length of the second side barrier base member and provides living quarters within an internal operating environment for an individual who is reentering a community after release from incarceration.

17. The method of claim 16, further comprising disposing a fourth furniture component on the first furniture component and adjacent to the bed assembly, the fourth furniture component with the bed assembly and the first furniture component providing the first continuous side barrier member, a combined height of the first and fourth furniture components being equal to a height of the bed assembly.

18. The method of claim 16, further comprising:

disposing a fourth furniture component on the first side barrier base member and adjacent to the first furniture component; and disposing a fifth furniture component on the fourth furniture component and adjacent to the first furniture component, the fourth furniture component and the fourth furniture component with the first furniture component and the bed assembly providing the first continuous side barrier member, and wherein a combined height of the fourth and fifth furniture components being equal to a height of the bed assembly.

19. The method of claim 16, further comprising coupling the first continuous side barrier member and the second continuous side barrier member via a fourth side barrier member, the first continuous side barrier member, the second continuous side barrier member, the third side barrier member and the fourth side barrier member defining a perimeter around the internal refuge room space.

20. A refuge room being configured for delivery to a predetermined internal operating environment in at least one shipping container, comprising:

first and second barrier base members each being positioned atop a floor of an internal operating environment;

a first side barrier member being positioned atop the floor of the internal operating environment, having a first end region and a second end region and defining a first window opening and a refuge room doorway between the first and second end regions of said first side barrier member;

a second side barrier member being disposed on said first barrier base member and having a first end region for coupling with the first end region of said first side barrier member and a second end region, said second side barrier member comprising a vertically-retractable wall bed assembly and a second storage component being disposed adjacent to the bed assembly to form a first continuous side barrier member between the first and second end regions of said second side barrier member;

a third side barrier member being disposed on said second barrier base member and having a first end region for coupling with the second end region of said first side barrier member and a second end region, said third side barrier member comprising a third storage component and a fourth storage component being disposed adjacent to the third storage component to form a second continuous side barrier member between the first and second end regions of said third side barrier member; and a fourth side barrier member being positioned atop the floor of the internal operating environment and defining a second window opening and having a first end region for coupling with the second end region of said second side barrier member and a second end region for coupling with the second end region of said third side barrier member, said first side barrier member, said second side barrier member, said third side barrier member and said fourth side barrier member defining a perimeter around an uncovered internal refuge room space in communication with the refuge room doorway, wherein a side panel of a selected shipping container forms a refuge room door being adjustably coupled with said first side barrier member and movable between a first position for permitting access to the internal refuge room space via the refuge room doorway and a second position for inhibiting access to the internal refuge room space via the refuge room doorway, and wherein the internal refuge room space provides living quarters within the internal operating environment for an individual who is reentering a community after release from incarceration.

* * * * *